US007045489B2

(12) United States Patent
Cotter et al.

(10) Patent No.: US 7,045,489 B2
(45) **Date of Patent: *May 16, 2006**

(54) FRICTION CONTROL COMPOSITIONS

(75) Inventors: John Cotter, North Vancouver (CA); Donald T. Eadie, North Vancouver (CA); Kelvin Spencer Chiddick, North Vancouver (CA)

(73) Assignee: Kelsan Technologies Corp., North Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/381,729

(22) PCT Filed: Sep. 28, 2001

(86) PCT No.: PCT/CA01/01359

§ 371 (c)(1),
(2), (4) Date: Oct. 9, 2003

(87) PCT Pub. No.: WO02/26919

PCT Pub. Date: Apr. 4, 2002

(65) Prior Publication Data

US 2004/0053790 A1 Mar. 18, 2004

Related U.S. Application Data

(60) Provisional application No. 60/236,347, filed on Sep. 29, 2000.

(51) Int. Cl.
*C10M 173/02* (2006.01)

(52) U.S. Cl. ..... 508/143; 508/219; 508/278; 508/304; 508/464; 508/472; 508/583; 508/588

(58) Field of Classification Search ..... 508/143, 508/219

See application file for complete search history.

(56) References Cited

U.S. PATENT DOCUMENTS

| | | | | |
|---|---|---|---|---|
| 4,052,323 | A | 10/1977 | Feneberger et al. | 252/23 |
| 4,303,537 | A | 12/1981 | Laepple et al. | 252/30 |
| 4,378,299 | A * | 3/1983 | Alexander | 508/219 |
| 4,915,856 | A | 4/1990 | Jamison | 252/26 |
| 5,173,204 | A | 12/1992 | Chiddick et al. | 252/30 |
| 5,271,854 | A | 12/1993 | Staub et al. | 252/29 |
| 5,308,516 | A | 5/1994 | Chiddick | 252/30 |
| 5,399,192 | A | 3/1995 | Yamasoe | 106/186 |
| 5,415,896 | A * | 5/1995 | Mulvihill et al. | 427/388.4 |

(Continued)

FOREIGN PATENT DOCUMENTS

| | | |
|---|---|---|
| EP | 0 261 438 | 3/1988 |

(Continued)

OTHER PUBLICATIONS

Matsumoto et al., *Creep Force Characteristics Between Rail and Wheel on Scaled Model*. p. 197-202.

(Continued)

*Primary Examiner*—Ellen M. McAvoy
(74) *Attorney, Agent, or Firm*—Cooley Godward LLP

(57) ABSTRACT

According to the invention there is provided a liquid friction control composition characterized as either having a high and positive friction characteristic or a low and neutral friction characteristic, comprising a retentivity agent. The liquid friction control composition may also comprise other components such as a solid lubricant, a wetting agent, a consistency modifier, and a preservative. The liquid friction control compositions may be used to modify the interfacial friction characteristics in sliding and rolling-sliding contact such as steel wheel-rail systems including mass transit and freight systems.

91 Claims, 6 Drawing Sheets

U.S. PATENT DOCUMENTS 6,136,757 A * 10/2000 Chiddick ..... 508/126
6,759,372 B1 * 7/2004 Cotter ..... 508/143

FOREIGN PATENT DOCUMENTS

EP 0 372 559 6/1990
WO 90/15123 12/1990
WO 98/13445 4/1998

OTHER PUBLICATIONS

Harrison et al., *Recent Developments in COF Measurements at the Rail/Wheel Interface*.

* cited by examiner

FRICTION CONTROL COMPOSITIONS

CROSS-REFERENCE TO RELATED APPLICATIONS

The present application is a U.S. National Phase Application of International Application PCT/CA01/01359 (filed Sep. 28, 2001) which claims the benefit of U.S. Provisional Application 60/236,347 (filed Sep. 29, 2000) and Canadian Patent Application No. 2,321,507 (filed Sep. 29, 2000) all of which are herein incorporated by reference in their entirety.

The invention relates to friction control compositions for applying to surfaces which are in sliding or rolling-sliding contact. More specifically, the present invention relates to friction control compositions that are retained on the applied surfaces for prolonged periods of time.

BACKGROUND OF THE INVENTION

The control of friction and wear of metal mechanical components that are in sliding or rolling-sliding contact is of great importance in the design and operation of many machines and mechanical systems. For example, many steel-rail and steel-wheel transportation systems including freight, passenger and mass transit systems suffer from the emission of high noise levels and extensive wear of mechanical components such as wheels, rails and other rail components such as ties. The origin of such noise emission, and the wear of mechanical components may be directly attributed to the frictional forces and behaviour that are generated between the wheel and the rail during operation of the system.

In a dynamic system wherein a wheel rolls on a rail, there is a constantly moving zone of contact. For purposes of discussion and analysis, it is convenient to treat the zone of contact as stationary while the rail and wheel move through the zone of contact. When the wheel moves through the zone of contact in exactly the same direction as the rail, the wheel is in an optimum state of rolling contact over the rail. In such a case, no appreciable friction exists between the wheel and the rail. However, because the wheel and the rail are profiled, often misaligned and subject to motions other than strict rolling, the respective velocities at which the wheel and the rail move through the zone of contact are not always the same. This is often observed when fixed-axle railcars negotiate curves wherein true rolling contact can only be maintained on both rails if the inner and the outer wheels rotate at different peripheral speeds. This is not possible on most fixed-axle railcars. Thus, under such conditions, the wheels undergo a combined rolling and sliding movement relative to the rails. Sliding movement may also arise when traction is lost on inclines thereby causing the driving wheels to slip.

The magnitude of the sliding movement is roughly dependent on the difference, expressed as a percentage, between the rail and wheel velocities at the point of contact. This percentage difference is termed creepage.

At creepage levels larger than about 1%, appreciable frictional forces are generated due to sliding, and these frictional forces result in noise and wear of components (H. Harrison, T. McCanney and J. Cotter (2000), Recent Developments in COF Measurements at the Rail/Wheel Interface, Proceedings The 5$^{th}$ International Conference on Contact Mechanics and Wear of Rail/Wheel Systems CM 2000 (SEIKEN Symposium No. 27), pp. 30–34, which is incorporated herein by reference). The noise emission is a result of a negative friction characteristic that is present between the wheel and the rail system. A negative friction characteristic is one wherein friction between the wheel and rail generally decreases as the creepage of the system increases in the region where the creep curve is saturated. Theoretically, noise and wear levels on wheel-rail systems may be reduced or eliminated by making the mechanical system very rigid, reducing the frictional forces between moving components to very low levels or by changing the friction characteristic from a negative to a positive one, that is by increasing friction between the rail and wheel in the region where the creep curve is saturated. Unfortunately, it is often impossible to impart greater rigidity to a mechanical system, such as in the case of a wheel and rail systems used by most trains. Alternatively, reducing the frictional forces between the wheel and the rail may greatly hamper adhesion and braking and is not always suitable for rail applications. In many situations, imparting a positive frictional characteristic between the wheel and rail is effective in reducing noise levels and wear of components.

It is also known that, wear of train wheels and rails may be accentuated by persistent to and fro movement resulting from the presence of clearances necessary to enable a train to move over a track. These effects may produce undulatory wave patterns on rail surfaces and termed corrugations. Corrugations increase noise levels beyond those for smooth rail-wheel interfaces and ultimately the problem can only be cured by grinding or machining the rail and wheel surfaces. This is both time consuming and expensive.

There are a number of lubricants known in the art and some of these are designed to reduce rail and wheel wear on rail roads and rapid transit systems. For example, U.S. Pat. No. 4,915,856 discloses a solid anti-wear, anti-friction lubricant. The product is a combination of anti-ware and anti-friction agents suspended in a solid polymeric carrier for application to the top of a rail. Friction of the carrier against the wheel activates the anti-wear and anti-friction agents. However, the product does not display a positive friction characteristic. Also, the product is a solid composition with poor retentivity.

There are several drawbacks associated with the use of compositions of the prior art, including solid stick compositions. First, outfitting railcars with friction modifier stick compositions and applying to large stretches of rail is wasteful if a noise problem exists at only a few specific locations on a track. Second, some railroads have a maintenance cycle that may last as long as 120 days. There is currently no stick technology that will allow solid lubricant or friction modifiers to last this period of time. Third, freight practice in North America is for freight cars to become separated all over the continent, therefore friction modifier sticks are required on many if not all rail cars which would be expensive and impractical. Similarly, top of rail friction management using solid sticks requires a closed system to achieve adequate buildup of the friction modifier product on the rail. A closed system is one where there is essentially a captive fleet without external trains entering or leaving the system. While city transit systems are typically closed, freight systems are typically open with widespread interchange of cars. In such a system, solid stick technology may be less practical.

U.S. Pat. Nos. 5,308,516, 5,173,204 and WO 90/15123 relate to solid friction modifier compositions having high and positive friction characteristics. These compositions display increased friction as a function of creepage, and comprise resins to impart the solid consistency of these formulations. The resins employed included amine and polyamide epoxy resins, polyurethane, polyester, polyethylene or polypropylene resins. However, these require continuous application in a closed loop system for optimal performance.

European Patent application 0 372 559 relates to solid coating compositions for lubrication which are capable of providing an optimum friction coefficient to places where it is applied, and at the same time are capable of lowering abrasion loss. However, the compositions do not have positive friction characteristics. Furthermore, there is no indication that these compositions are optimized for durability or retentivity on the surfaces to which they are applied.

Many lubricant compositions of the prior art are either formulated into solid sticks or are viscous liquids (pastes) and thus may not be applied to sliding and rolling-sliding systems as an atomized spray. The application of a liquid friction control composition in an atomized spray, in many instances reduces the amount of the composition to be applied to a rail system and provides for a more even distribution of the friction modifier composition at the required site. Furthermore, atomized sprays dry rapidly which may lead to minimizing the potential for undesired locomotive wheel slip.

Applying liquid-based compositions to the top of the rail has distinct advantages over using a solid stick delivery system applied to the wheels. Using a liquid system allows for site-specific application via a hirail, wayside or onboard system. Such specific application is not possible with the solid delivery system that continually applies product to the wheels. Furthermore the low transference rate of the solid stick application method will not yield any benefits until the track is fully conditioned. This is an unlikely situation for a Class 1 rail line due to the extensive amount of track that must be covered and the presence of rail cars not possessing the solid stick lubricant. Liquid systems avoid this problem as the product is applied to the top of the rail, allowing all axles of the train to come in contact with, and benefit immediately from the product. However, this is not always true as the ability of the applied film to remain adhered to the rail and provide friction control is limited. Under certain conditions liquid products have worn off before a single train pass.

WO 98/13445 describes several water-based compositions exhibiting a range of frictional compositions including positive frictional characteristics between two steel bodies in rolling-sliding contact. While exhibiting several desirous properties relating to frictional control, these composition exhibit poor retentivity, and do not remain associated with the rail for long periods of time, requiring repeated application for optimized performance. These compositions are useful for specific applications, however, for optimized performance repeated re-application is required, and there is an associated increase in cost. Furthermore, due to several of the characteristics of these liquid compositions, these compositions have been found to be unsuitable for atomized spray applications.

While a number of friction modifiers in the prior art exhibit positive friction characteristics, a limitation of these friction modifiers is their inability to be retained on the steel surface and remain effective over prolonged periods. In fact, friction modifiers must be repeatedly applied to the rail head or flange interface to ensure proper friction control and such repeated application can result in substantial costs. Thus, there is a need for friction modifier compositions which exhibit improved retentivity, durability and function over prolonged periods. Such compositions may be effectively used in open in either closed or open rail systems. These compositions may include solid, paste or liquid formulations.

It is an object of the present invention to overcome drawbacks of the prior art.

The above object is met by a combination of the features of the main claims. The sub claims disclose further advantageous embodiments of the invention.

SUMMARY OF THE INVENTION

The invention relates to liquid friction control compositions. More specifically, the present invention relates to friction control compositions for lubricating surfaces which are in sliding or rolling-sliding contact with increased retentivity.

The present invention relates to a liquid friction control composition comprising a film forming retentivity agent. Preferably the friction control composition is selected from the group consisting of a neutral friction characteristic (LCF0, a high positive friction characteristic (HPF) and a very high positive friction chararcteristic (VHPF).

The present invention also embraces the friction control composition defined above further comprising a rheological control agent.

The present invention provides for a friction control composition as defined above further comprising a friction modifier.

According to the present invention there is also provided a friction control composition as defined above comprising water.

The friction control composition as defined above may further comprise a wetting agent, an antibacterial agent, a consistency modifier, a defoaming agent, or a combination thereof.

Furthermore, the present invention pertains to a friction control composition as defined above defined above wherein the retentivity agent is selected from the group consisting of acrylic, polyvinyl alcohol, polyvinyl chloride, oxazoline, epoxy, alkyd, modified alkyd, acrylic latex, acrylic epoxy hybrids, polyurethane, styrene acrylate, and styrene butadiene based compounds.

This invention also embraces a friction control composition as defined above, wherein the rheological agent is selected from the group consisting of clay, bentonite, montmorillonite, caseine, carboxymethylcellulose, carboxyhydroxymethylcellulose, ethoxymethylcellulose, chitosan, and starch.

The present invention is directed to a liquid friction control composition (base composition) comprising:

(a) from about 40 to about 95 percent water;
(b) from about 0.5 to about 50 percent rheological agent;
(c) from about 0.5 to about 40 percent retentivity agent;
(d) from about 0 to about 40 weight percent lubricant; and
(e) from about 0 to about 25 weight percent friction modifier, wherein, if said lubricant is about 0 weight percent, then said composition comprises at least about 0.5 weight percent friction modifier, and wherein if said friction modifier is about 0 weight percent, then said composition comprises at least about 1 weight percent lubricant.

According to the present invention there is provided a method of controlling noise between two steel surfaces in sliding-rolling contact comprising applying any one of the liquid friction control compositions as defined above to at least one of said two steel surfaces. This invention also includes a the above method wherein in the step of applying, the liquid control composition is sprayed onto said at least one of two steel surfaces.

The present invention also provides a liquid friction control composition (composition A; an HPF) comprising:

(a) from about 40 to about 95 weight percent water;
(b) from about 0.5 to about 30 weight percent rheological control agent;
(c) from about 0.5 to about 25 weight percent friction modifier;
(d) from about 0.5 to about 40 weight percent retentivity agent; and
(c) from about 0.02 to about 25 weight percent lubricant.

This liquid friction control composition may further comprising a consistency modifier, an antibacterial agent, a wetting agent or a combination thereof. The retentivity agent of this liquid control composition may be selected from the group consisting of acrylic, epoxy, and styrene butadiene based compounds, and the rheological agent of this friction control composition may be selected from the group consisting of clay, bentonite, montmorillonite, caseine, carboxymethylcellulose, carboxyhydroxymethylcellulose, ethoxymethylcellulose, chitosan, and starch.

The present invention also relates to a liquid friction control composition (composition B; a VHPF) comprising:

(a) from about 40 to about 80 weight percent water;
(b) from about 0.5 to about 30 weight percent rheological control agent;
(c) from about 2 to about 20 weight percent friction modifier and;
(d) from about 0.5 to about 40 weight percent retentivity agent.

This liquid friction control composition may further comprising a consistency modifier, an antibacterial agent, a wetting agent or a combination thereof. The retentivity agent of this liquid control composition may be selected from the group consisting of acrylic, epoxy, and styrene butadiene based compounds, and the rheological agent of this friction control composition may be selected from the group consisting of clay, bentonite, montmorillonite, caseine, carboxymethylcellulose, carboxyhydroxymethylcellulose, ethoxymethylcellulose, chitosan, and starch.

The present invention also provides a liquid friction control composition (composition C; an LCF) comprising:

(a) from about 40 to about 80 weight percent water;
(b) from about 0.5 to about 50 weight percent rheological control agent;
(c) from about 0.5 to about 40 weight percent retentivity agent and
(c) from about 1 to about 40 weight percent lubricant.

This liquid friction control composition may further comprising a consistency modifier, an antibacterial agent, a wetting agent or a combination thereof. The retentivity agent of this liquid control composition may be selected from the group consisting of acrylic, epoxy, and styrene butadiene based compounds, and the rheological agent of this friction control composition may be selected from the group consisting of clay, bentonite, montmorillonite, caseine, carboxymethylcellulose, carboxyhydroxymethylcellulose, ethoxymethylcellulose, chitosan, and starch.

The present invention also pertains to a method of reducing lateral forces between two steel surfaces in sliding-rolling contact comprising applying a liquid friction control composition, selected from composition A (HPF) and composition C (LCF), defined above, to at least one of the two steel surfaces.

The present invention embraces a method of reducing drawbar pull between two or more train cars, the method comprising applying a liquid friction control composition selected from the group consiting of composition A (HPF) and composition C (LCF), defined above, to a surface of one or more wheels of the train cars, or the rail surface over which the train cars travel.

The present invention is directed to compositions that control the friction between two steel bodies in sliding-rolling contact. One advantage of the friction control compositions of the present invention pertains to an increased retentivity of the composition between the two surfaces, when compared with prior art compounds that readily rub or burn off the applied surfaces during use. Furthermore, the compositions of the present invention exhibit properties that are well adapted for a variety of application techniques that minimizes the amount of composition that needs to be applied. Furthermore, by using these application techniques administration of accurate amounts of composition may be obtained. For example, liquid compositions are suited for spraying onto a surface thereby ensuring a uniform coating of the surface and optimizing the amount of composition to be applied. Compositions may be applied from a wayside applicator ensuring a reduced amount of friction controlling composition to be applied to the surface. Furthermore, by combining application techniques, or locations of applicators, combinations of compositions may be applied to different surfaces that are in sliding-rolling contact to optimize wear, and reduce noise and other properties, for example lateral forces, and drawbar pull.

This summary does not necessarily describe all necessary features of the invention but that the invention may also reside in a sub-combination of the described features.

BRIEF DESCRIPTION OF THE DRAWINGS

These and other features of the invention will become more apparent from the following description in which reference is made to the appended drawings wherein:

FIG. 1A shows the coefficient of friction versus % creep for a friction modifier characterized as having a neutral friction characteristic, see Example 1—LCF. FIG. 1B shows the coefficient of friction versus % creep for a friction modifier characterized as having a positive friction characteristic see Example 1—HPF. FIG. 1C shows the coefficient of friction versus % creep for a friction modifier characterized as having a positive friction characteristic, more specifically a very high positive friction characteristic see Example 1—VHPF.

FIG. 3 shows a graphical representation of the retentivity of a liquid friction control composition of the present invention.

DESCRIPTION OF PREFERRED EMBODIMENT

Figure 1:
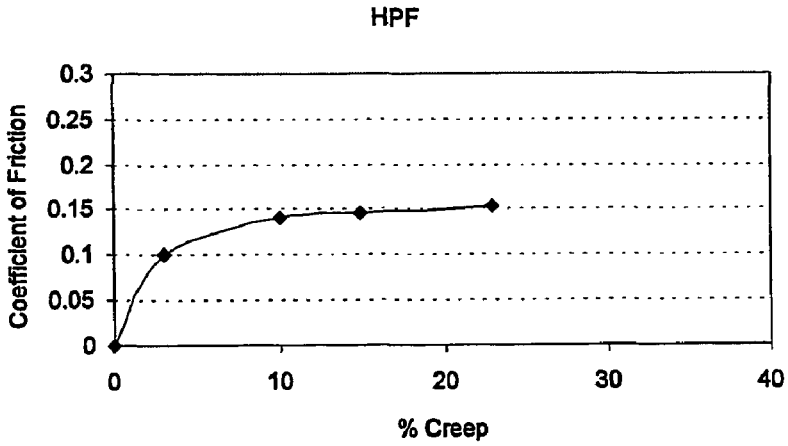
FIG. 1 shows a graphical representation of coefficient of friction versus % creep for three different friction modifier formulations.
Figure 1:
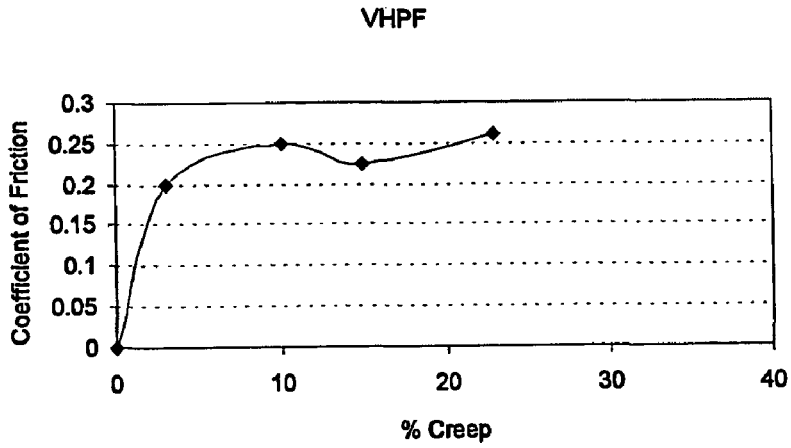
Figure 1:
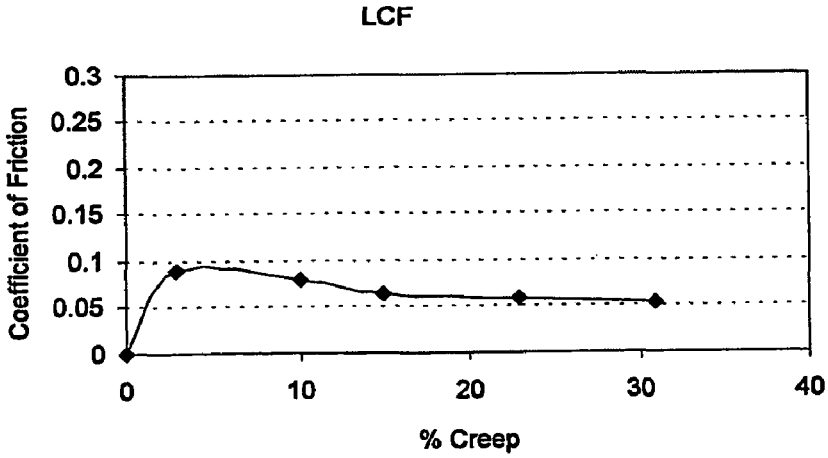

The invention relates to friction control compositions for use on steel surfaces which are in sliding or rolling-sliding contact. More specifically, the present invention relates to friction control compositions that are retained on the applied surfaces for prolonged periods of time.

The following description is of a preferred embodiment by way of example only and without limitation to the combination of features necessary for carrying the invention into effect.

The friction control compositions of the present invention generally comprise a rheological control agent, a friction modifier, and a retentivity agent. If a liquid formulation is desired, the friction control composition of the present invention may also comprise water or another composition-compatible solvent. The friction control formulations of the present may also comprise one or more lubricants. Even though the compositions of the present invention, when comprising water or other compatible solvent, are effective for use within liquid formulations, the composition may be formulated into a paste or solid form and these compositions exhibit many of the advantages of the frictional composition described herein. The compositions as described herein may also comprise wetting agents, dispersants, anti-bacterial agents, and the like as required.

By the term 'positive friction characteristic', it is meant that the coefficient of friction between two surfaces in sliding or rolling-sliding contact increases as the creepage between the two surfaces increases. The term 'creepage' is a common term used in the art and its meaning is readily apparent to someone of skill in the art. For example, in the railroad industry, creepage may be described as the percentage difference between the magnitude of the velocity of the sliding movement of a rail relative to the magnitude of the tangential velocity of the wheel at the point of contact between wheel and rail, assuming a stationary zone of contact and a dynamic rail and wheel.

Various methods in the art may be used to determine if a friction control composition exhibits a positive friction characteristic. For example, but not wishing to be limiting, in the lab a positive friction characteristic may be identified using a disk rheometer or an Amsler machine ((H. Harrison, T. McCanney and J. Cotter (2000), Recent Developments in COF Measurements at the Rail/Wheel Interface, Proceedings The 5$^{th}$ International Conference on Contact Mechanics and Wear of Rail/Wheel Systems CM 2000 (SEIKEN Symposium No. 27), pp. 30–34, which is incorporated herein by reference). An Amsler machine consists of two parallel discs being run by each other with variable loads being applied against the two discs. This apparatus is designed to stimulate two steel surfaces in sliding-rolling contact. The discs are geared so that the axle of one disc runs about 10% faster than the other. By varying the diameter of the discs, different creep levels can be obtained. The torque caused by friction between the discs is measured and the coefficient of friction is calculated from the torque measurements. In determining the friction characteristic of a friction modifier composition it is preferable that the friction control composition be fully dry prior to performing measurements for friction characteristics. However, measurements using wet or semi-dry friction control compositions may provide additional information relating to the friction control compositions. Similarly, creep characteristics may be determined using a train with specially designed bogies and wheels that can measure forces acting at the contact patch between the rail and wheel, and determine the creep rates in lateral and longitudinal direction simultaneously.

As would be evident to some skilled in the art, other two roller systems may be used to determine frictional control characteristics of compositions (e.g. A. Matsumo, Y. Sato, H. Ono, Y. Wang, M. Yamamoto, M. Tanimoto and Y. Oka (2000), Creep force characteristics between rail and wheel on scaled model, Proceedings The 5$^{th}$ International Conference on Contact Mechanics and Wear of Rail/Wheel Systems CM 2000 (SEIKEN Symposium No. 27), pp. 197–202; which is incorporated herein by reference). Sliding friction characteristics of a composition in the field, may be determined using for example but not limited to, a push tribometer or TriboRailer (H. Harrison, T. McCanney and J. Cotter (2000), Recent Developments in COF Measurements at the Rail/Wheel Interface, Proceedings The 5$^{th}$ International Conference on Contact Mechanics and Wear of Rail/Wheel Systems CM 2000 (SEIKEN Symposium No. 27), pp. 30–34, which is incorporated herein by reference).

FIG. 1A displays a graphical representation of a typical coefficient of friction versus % creep curve, as determined using an amsler machine, for a composition characterized as having a neutral friction characteristic (LCF), in that with increased creepage, there is a low coeffecient of friction. As described herein, LCF can be characterized as having a coefficient of friction of less than about 0.2 when measured with a push tribometer. Preferably, under field conditions, LCF exhibits a coefficient of friction of about 0.15 or less. A positive friction characteristic is one in which friction between the wheel and rail systems increases as the creepage of the system increases. FIG. 1B and FIG. 1C display graphical representations of typical coefficient of friction versus % creep curves for compositions characterized as having a high positive friction (HPF) characteristic and a very high positive friction (VHPF) characteristic, respectively. As described herein, HPF can be characterized as having a coefficient of friction from about 0.28 to about 0.4 when measured with a push tribometer. Preferably, under field conditions, HPF exhibits a coefficient of friction of about 0.35. VHPF can be characterized as having a coefficient of friction from about 0.45 to about 0.55 when measured with a push tribometer. Preferably, under field conditions, VHPF exhibits a coefficient of friction of 0.5.

Wheel squeal associated with a curved track may be caused by several factors including wheel flange contact with the rail gauge face, and stick-slip due to lateral creep of the wheel across the rail head. Without wishing to be bound by theory, lateral creep of the wheel across the rail head is thought to be the most probable cause of wheel squeal, while wheel flange contact with the rail gauge playing an important, but secondary role. Studies, as described herein, demonstrate that different friction control compositions may be applied to different faces of the rail-wheel interface to effectively control wheel squeal. For example, a composition with a positive friction characteristic may be applied to the head of the rail-wheel interface to reduce lateral slip-stick of the wheel tread across the rail head, and a low friction modifier composition may be applied to the gauge face of the rail-wheel flange to reduce the flanging effect of the lead axle of a train car.

By the term 'rheological control agent' it is meant a compound capable of absorbing liquid, for example but not limited to water, and physically swell. A rheological control agent may also function as a thickening agent, and help keep the components of the composition in a dispersed form. This agent functions to suspend active ingredients in a uniform manner in a liquid phase, and to control the flow properties and viscosity of the composition. This agent may also function by modifying the drying characteristics of a friction modifier composition. Furthermore, the rheological control agent may provide a continuous phase matrix capable of maintaining the solid lubricant in a discontinuous phase matrix. Rheological control agents include, but are not limited to clays such as bentonite (montmorillonite), for example but not limited to, HECTABRITE™, caseine, carboxymethylcellulose (CMC), carboxy-hydroxymethyl cellulose, for example but not limited to METHOCEL™ (Dow Chemical Company), ethoxymethylcellulose, chitosan, and starches.

By the term 'friction modifier' it is meant a material which imparts a positive friction characteristic to the friction control composition of the present invention, or one which enhances the positive friction characteristic of a liquid friction control composition when compared to a similar composition which lacks a friction modifier. The friction modifier preferably comprises a powderized mineral and has a particle size in the range of about 0.5 microns to about 10 microns. Further, the friction modifier may be soluble, insoluble or partially soluble in water and preferably maintains a particle size in the range of about 0.5 microns to about 10 microns after the composition is deposited on a surface and the liquid component of the composition has evaporated. Friction modifiers, described in U.S. Pat. No. 5,173,204 and WO98/13445 (which are incorporated herein by reference) may be used in the composition described herein. Friction modifiers may include, but are not limited to:

Friction Modifiers
Whiting (Calcium Carbonate)
Magnesium Carbonate
Talc (Magnesium Silicate)
Bentonite (Natural Clay)
Coal Dust (Ground Coal)
Blanc Fixe (Calcium Sulphate)
Asbestors (Asbestine derivative of asbestos)
China Clay; Kaolin type clay (Aluminium Silicate)
Silica—Amorphous (Synthetic)
Naturally occurring
Slate Powder
Diatomaceous Earth
Zinc Stearate
Aluminium Stearate
Magnesium Carbonate
White Lead (Lead Oxide)
Basic Lead Carbonate
Zinc Oxide
Antimony Oxide
Dolomite (MgCo CaCo)
Calcium Sulphate
Barium Sulphate (e.g. Baryten)
Polyethylene Fibres
Aluminum Oxide
Magnesium Oxide
Zirconium Oxide
or combination thereof.

By the term 'retentivity agent' it is meant a chemical, compound or combination thereof which increases the effective lifetime of operation or the durability of a friction control composition between two or more surfaces is sliding-rolling contact. A retentivity agent provides, or increases film strength and adherence to a substrate. Preferably a retentivity agent is capable of associating with components of the friction composition and forming a film on the surface to which it is applied, thereby increasing the durability of the composition on the surface exposed to sliding-rolling contact. Typically, a retentivity agent exhibits the desired properties (for example, increased film strength and adherence to substrate) after the agent has coalesced or polymerized as the case may be. It may be desireable under some conditions Without wishing to be bound by theory, in the case of a polymeric retentivity agent, the particles of the agent relax and unwind during curing. Once the solvent fully evaporates a mat of overlapping polymer strands is formed, and it is this highly interwoven mat that determines the properties of the film. The chemical nature of the polymer strands modifies how the strands adhere to each other and the substrate.

It is preferable that a retentivity agent has the ability to bind the lubricant and friction modifier components so that these components form a thin layer and resist displacement from the wheel-rail contact patch. It is also preferable that retentivity agents maintain physical integrity during use and are not burned off during use. Suitable retentivity agents exhibit a high solids loading capacity, reduced viscosity, and if desired a low minimum film forming temperature. Examples of retentivity agents, include but are not limited to:

- acrylics, for example but not limited to, RHOPLEX™ AC 264, RHOPLEX™ MV 23LO or MAINCOTE™ HG56 (Rohm & Haas);
- polyvinyls, polyvinyl alcohol, polyvinyl chloride or a combination thereof, for example, but not limited to, AIRFLEX™ 728 (Air Products and Chemicals), EVANOL™ (Dupont), ROVACE™ 9100, or ROVACE™ 0165 (Rohm & Haas);
- oxazolines, for example, but not limited to, AQUAZOL™ 50 & 500 (Polymer Chemistry);
- styrene butadiene compounds, for example but not limited to, DOW LATEX™ 226 & 240 (Dow Chemical Co.);
- styrene acrylate, for example but not limited to, ACRONAL™ S 760 (BASF), RHOPLEX™ E-323LO, RHOPLEX™ HG-74P (Rohm & Hass), EMULSION™ E-1630, E-3233 (Rohm & Hass);
- epoxies, comprising a two part system of a resin and a curing agent. Choice of resin may depend upon the solvent used for the friction modifier composition. For example, which is not to be considered limiting, in aqueous formulations suitable resin include water borne epoxies, such as, ANCARES™ AR 550 (is 2,2'-[(1-methylethylidene)bis(4,1-phenyleneoxymethylene)]bisoxirane homopolymer; Air Products and Chemicals), EPOTUF™ 37-147 (Bisphenol A-based epoxy; Reichhold). An amine or amide curing agents, for example, but not limited to ANQUAMINE™ 419, 456 and ANCAMINE™ K54 (Air Products and Chemicals) may be used with aqueous epoxy formulations.

However, increased retentivity has been observed when an epoxy resin, in the absence of a curing agent is used alone. Preferably, the epoxy resin is mixed with a curing agent during use. Other components that may be added to the composition include hydrocarbon resins that increase the adhesion of the composition to contaminated surfaces, for example, but not limited to, EPODIL™-L (Air Products Ltd.). If an organic based solvent is used, then non-aqueous epoxy resins and curing agents, may be used;

alkyd, modified alkyds;

acrylic latex;

acrylic epoxy hybrid;

urethane acrylic;

polyurethane dispersions;

various gums and resins; and a combination thereof.

Increased retentivity of a friction modifier composition comprising a retentivity agent, is observed in compositions comprising from about 0.5 to about 40 weight percent retentivity agent. Preferably, the composition comprises about 1 to about 20 weight percent retentivity agent.

As an epoxy is a two-part system, the properties of this retentivity agent may be modulated by varying the amount of resin or curing agent within the epoxy mixture. For example, which is described in more detail below, increased retentivity of a friction modifier composition comprising an epoxy resin and curing agent, is observed in compositions comprising from about 1 to about 50 wt % epoxy resin. Preferably, the composition comprises from about 2 to about 20 wt % epoxy resin. Furthermore, increasing the amount of curing agent, relative to the amount of resin, for example, but not limited to 0.005 to about 0.8 (resin:curing ratio), may also result in increased retentivity. As described below, friction modifier compositions comprising epoxy resin in the absence of curing agent, also exhibit high retentivity. Without wishing to bound by theory, it is possible that without a curing agent the applied epoxy film maintains an elastic quality allowing it to withstand high pressures arising from steel surfaces in sliding and rolling contact.

Figure 3A:
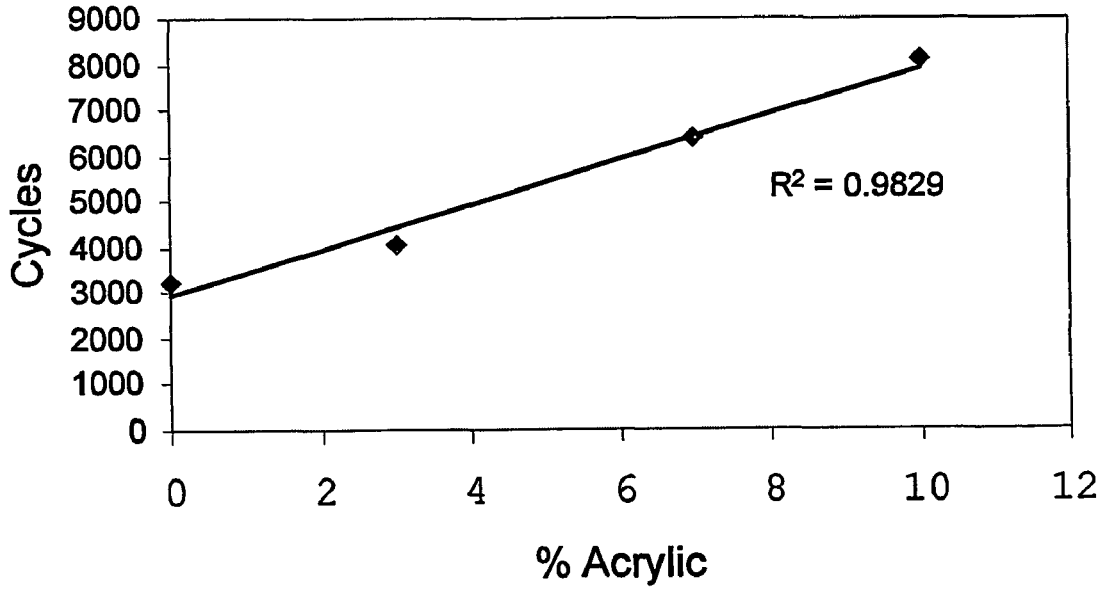
FIG. 3A shows retentivity as determined using an Amsler machine, as a function of weight percentage of a retentivity agent (RHOPLEX™ AC 264) in the composition.
Figure 3B:
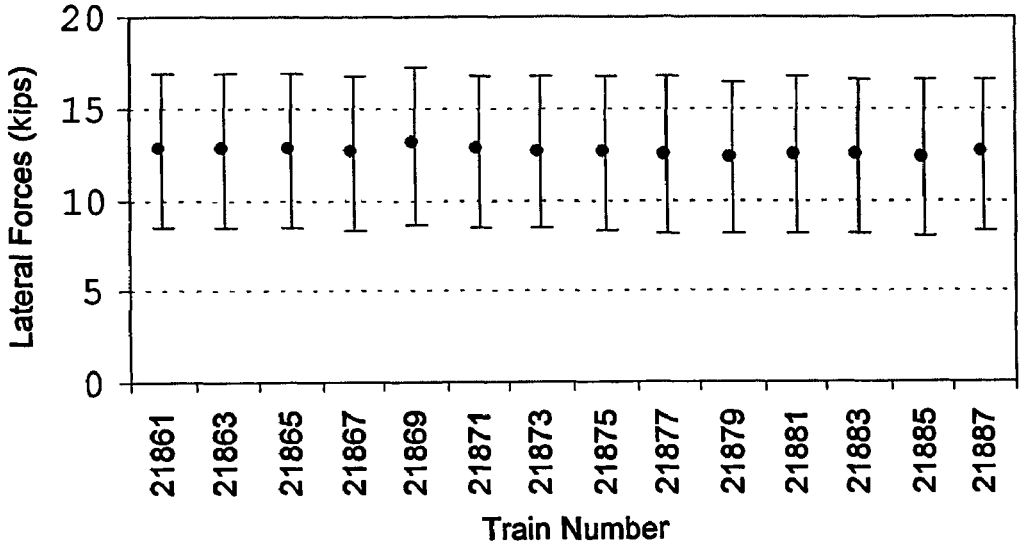
FIG. 3B shows the lateral force baseline for repeated train passes over a 6° curve in the absence of any friction modifier composition.

Retentivity of a composition may be determined using an Amsler machine or other suitable device (see above) and noting the number of cycles that an effect is maintained (see FIG. 3A). Furthermore, in the railroad industry retentivity may be measured as a function of the number of axle passes for which a desired effect, such as, but not limited to sound reduction, drawbar force reduction, lateral force reduction, or frictional level, is maintained (e.g. see FIGS. 3B and 3C), or by using a push tribometer. Without being bound by theory, it is thought that retentivity agents possess the ability to form a durable film between surfaces in sliding and rolling-sliding contact, such as but not limited to wheel-rail interfaces.

A solvent is also required so that the friction modifying compositions of the present invention may be mixed and applied to a substrate. The solvent may be either an organic or an aqueous depending upon the application requirements, for example, cost of composition, required speed of drying, environmental considerations etc. Organic solvents may include, but are not limited to, methanol, however, other solvents may be used to reduce drying times of the applied composition, increase compatibility of the composition with contaminated substrates, or both decrease drying times and increase compatibility with contaminated substrates. Preferably the solvent is water. Usually in water-borne systems the retentivity agent is not truly in a solution with the solvent, but instead is a dispersion.

By the term 'lubricant' it is meant a chemical, compound or mixture thereof which is capable of reducing the coefficient of friction between two surfaces in sliding or rolling-sliding contact. Lubricants include but are not limited to molybdenum disulfide, graphite, aluminium stearate, zinc stearate and carbon compounds such as, but not limited to coal dust, and carbon fibres. Preferably, the lubricants, if employed, in the compositions of the present invention are molybdenum disulfide, graphite and TEFLON™ (polytetrafluoroethylene).

Examples of preservatives include, but are not limited to ammonia, alcohols or biocidal agents, for example but not limited to OXABAN A™. An example of a defoaming agent is COLLOIDS 648™.

The friction control compositions of the present invention may also include other components, such as but not limited to preservatives, wetting agents, consistency modifiers, and rheological control agents, either alone or in combination.

Examples of preservatives include, but are not limited to ammonia, alcohols or biocidal agents, for example but not limited to OXABAN A™. An example of a defoaming agent is Colloids 648.

A wetting agent which may be included in the compositions of the present invention may include, but is not limited to, nonyl phenoxypolyol, or Co-630™ (Union Carbide). The wetting agent may facilitate the formation of a water layer around the lubricant and friction modifier particles within the matrix of the rheological control agent, friction modifier and lubricant. It is well known within the art that wetting agents reduce surface tension of water and this may facilitate penetration of the friction control composition into cracks of the surfaces which are in sliding or rolling-sliding contact. Further, a wetting agent may aid in the dispersion of the retentivity agent in the liquid friction control composition. The wetting agent may also be capable of emulsifying grease, which may be present between surfaces in sliding and rolling-sliding contact, for example, but not wishing to be limiting surfaces such as a steel-wheel and a steel-rail. The wetting agent may also function by controlling dispersion and minimizing agglomeration of solid particles within the composition.

The consistency modifier which may be included in the friction control compositions of the present invention may comprise, but are not limited to glycerine, alcohols, glycols such as propylene glycol or combinations thereof. The addition of a consistency modifier may permit the friction control compositions of the present invention to be formulated with a desired consistency. In addition, the consistency modifier may alter other properties of the friction control compositions, such as the low temperature properties of the compositions, thereby allowing the friction control compositions of the present invention to be formulated for operation under varying temperatures.

It is also possible that a single component of the present invention may have multiple functions. For example, but not wishing to be limiting, alcohol may be used as a preservative and it may also be used as a consistency modifier to modulate the viscosity of the friction modifier composition of the present invention. Alternatively, alcohol may also be used to lower the freezing point of the friction modifier compositions of the present invention.

Figure 2:
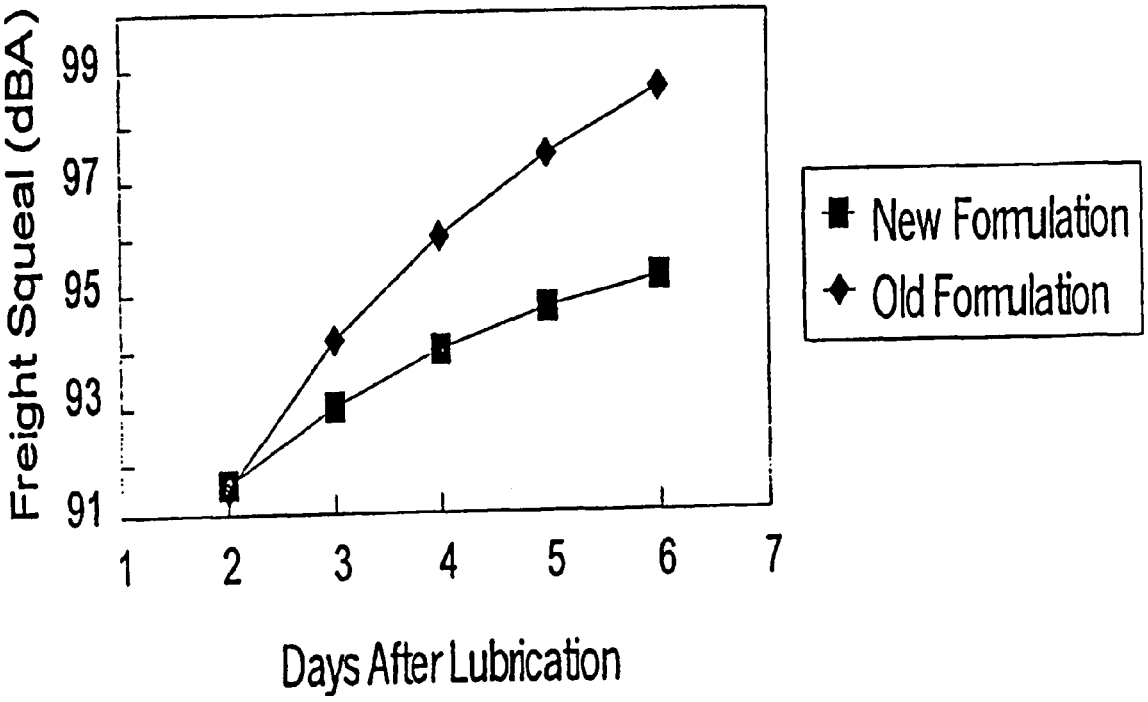
FIG. 2 shows a graphical representation depicting freight nosie squeal with a dry wheel-rail system and a wheel-rail system comprising a liquid friction control composition of the present invention.

Another benefit associated with the use of the friction control compositions of the present invention is the reduction of lateral forces associated with steel-rail and steel-wheel systems of freight and mass transit systems. The reduction of lateral forces may reduce rail wear (gauge widening) and reduce rail replacement costs. Lateral forces may be determined using a curved or tangential track rigged with appropriate strain gauges. Referring now to FIG. 2, there is shown the magnitude of the lateral forces on a steel-wheel and steel-rail system for a variety of different car types in the presence or absence of a liquid friction control composition according to the present invention. As shown in FIG. 2, the use of a friction control composition according to the present invention, in this case, HPF, reduces maximum and average lateral forces by at least about 50% when compared with lateral forces measured on a dry rail and wheel system.

Yet another benefit associated with the use of the friction control compositions of the present invention is the reduction of energy consumption as measured by, for example but not limited to, drawbar force, associated with steel-rail and steel-wheel systems of freight and mass transit systems. The reduction of energy consumption has an associated decrease in operating costs. The use of a friction control composition according to the present invention, in this case, HPF, reduces drawbar force with increasing application rate of HPF, by at least about 13 to about 30% when compared with drawbar forces measured on a dry rail and wheel system.

There are several methods of applying a water-based product to the top of the rail. For example which are not to be considered limiting, such methods include: onboard, wayside or hirail system. An onboard system sprays the liquid from a tank (typically located after the last driving locomotive) onto the rail. The wayside, is an apparatus located alongside the track that pumps product onto the rail after being triggered by an approaching train. A hirail is a modified pickup truck that has the capability of driving along the rail. The truck is equipped with a storage tank (or tanks), a pump and an air spray system that allows it to apply a thin film onto the track. The hirail may apply compositions when and where it is needed, unlike the stationary automated wayside. Only a few hirail vehicles are required to cover a large area, whereas the onboard system requires that at least one locomotive per train be equipped to dispense the product.

Referring now to FIG. 3 there is shown the effect of a retentivity agent, for example, but not limited to acrylic, on the durability of a liquid friction control composition between two steel surfaces in sliding-rolling contact. Amsler retentivity in this case is determined by the number of cycles that the friction modifier composition exerts an effect, for example, but not limited to maintaining the coefficient of friction below about 0.4, or other suitable level as required by the application. The retentivity of the composition is approximately linearly dependent on the weight percentage of the retentivity agent in the composition, for example but not limited to, from about 1% weight/weight (w/w) to about 15% w/w retentivity agent. In this range, retentivity increases from about 5000 cycles to about 13000 cycles, as determined using an Amsler machine, representing about a 2.5-fold increase in the effective durability and use of the composition. A similar increase in retentivity is also observed under field conditions where reduced lateral forces are observed for at least about 5,000 axle passes (FIGS. 3B, 3C). A similar prolonged effect of the frictional modifier compositions as described herein comprising a retentivity agent is observed for other properties associated with the application of compositions of the present invention including noise reduction and reduced draw-bar forces. In the absence of a retentivity agent, an increase in lateral force, or increase in noise levels, or an increase in draw-bar forces, is observed after about several hundred axle passes.

The effect of the retentivity agent in prolonging the effectiveness of the compositions of the present invention is maximized if the friction modifier composition is allowed to set for as long as possible prior to its use. However, this length of time may vary under field conditions. In field studies where friction modifier compositions, as described herein, were applied to a track, and lateral forces were measured on cars passing over the treated track during and after application, following an initail decrease in lateral force, an increase in lateral force was observed after about 1,200 axle passes. However, if the composition is allowed to set prior to use, reduced lateral forces were observed for about 5,000 to about 6,000 axle passes. Therefore, in order to decrease the setting time of the liquid frictional compositions as described herein, any compatible solvent, including but not limited to water, that permits a uniform application of the composition, and that readily dries may be used in the liquid compositions of the present invention. Furthermore, the present invention contemplates the use of fast drying or rapid curing film forming retentivity agents, for example, epoxy-based film forming retentivity agents to decrease the required setting time of the composition. Such epoxy based compositions have also been found to increase film strength.

Figure 4:
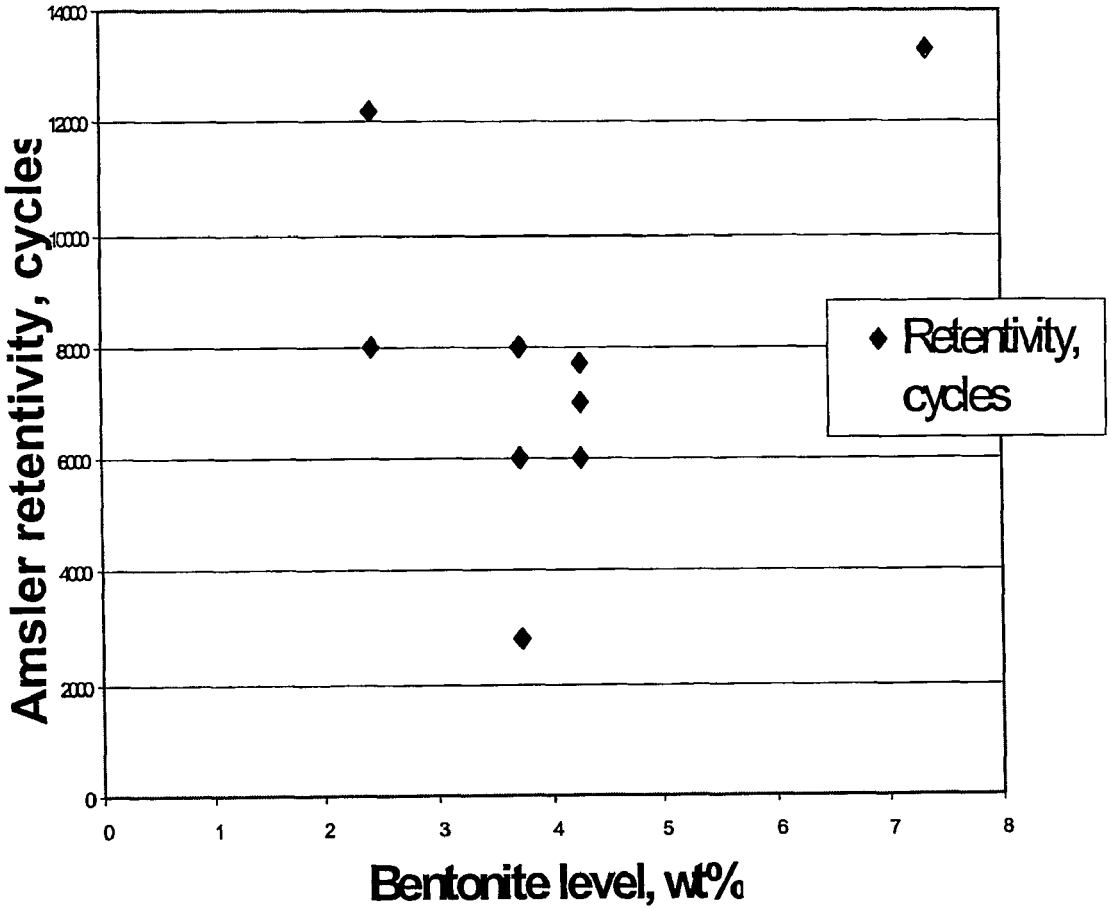
FIG. 4 shows the retentivity of a liquid friction control composition of the present invention as a function of weight percentage of a rheological control agent in the composition.

In contrast to the results obtained with acrylic, the level of bentonite (a rheological agent) does not affect retentivity as shown in FIG. 4.

Therefore, according to one aspect of the present invention there is provided a liquid friction control composition exhibiting a high positive frictional (HPF) characteristic comprising:

(a) from about 40 to about 95 weight percent water;
(b) from about 0.5 to about 30 weight percent rheological control agent;
(c) from about 0.5 to about 25 weight percent friction modifier;
(d) from about 0.5 to about 40 weight percent retentivity agent; and
(c) from about 0.02 to about 25 weight percent lubricant.

Optionally, this composition may also comprise consistency modifiers, antibacterial agents and wetting agents. Preferably, the composition comprises:

(a) from about 50 to about 80 weight percent water;
(b) from about 1 to about 10 weight percent rheological control agent;
(c) from about 1 to about 5 weight percent friction modifier;
(d) from about 1 to about 16 weight percent retentivity agent; and
(e) from about 1 to about 13 weight percent lubricant.

According to another aspect of the present invention there is provided a liquid friction control composition characterized as having a very high positive friction (VHPF) characteristic. The composition comprises:

(a) from about 40 to about 80 weight percent water;
(b) from about 0.5 to about 30 weight percent rheological control agent;
(c) from about 2 to about 20 weight percent friction modifier and;
(d) from about 0.5 to about 40 weight percent retentivity agent.

Optionally, this composition may also comprise consistency modifiers, antibacterial agents and wetting agents. Preferably, the composition comprises:

(a) from about 55 to 75 about weight percent water;
(b) from about 1 to about 9 weight percent rheological control agent;
(c) from about 5 to about 9 weight percent friction modifier; and
(d) from about 2 to about 11 weight percent retentivity agent.

According to yet another aspect of the present invention there is provided a liquid friction control composition characterized as having a low coefficient of friction (LCF) characteristic. The composition comprises:

(a) from about 40 to about 80 weight percent water;
(b) from about 0.5 to about 50 weight percent rheological control agent;
(c) from about 0.5 to about 40 weight percent retentivity agent, and
(c) from about 1 to about 40 weight percent lubricant.

Optionally, this composition may also comprise consistency modifiers, antibacterial agents and wetting agents. Preferably, the composition comprises:

(a) from about 45 to about 65 weight percent water;
(b) from about 4 to about 9 weight percent rheological control agent;
(c) from about 10 to about 20 weight percent retentivity agent; and
(d) from about 3 to about 13 weight percent lubricant.

The friction control compositions of the present invention may therefore be used for modifying friction on surfaces that are in sliding or rolling-sliding contact, such as railway wheel flanges and rail gauge faces. However, it is also contemplated that the friction control compositions of the present invention may be used to modify friction on other metallic, non-metallic or partially metallic surfaces that are in sliding or rolling-sliding contact.

The compositions of the present invention may be applied to metal surfaces such as rail surfaces or couplings by any method known in the art. For example, but not wishing to be limiting, the compositions of the present invention may be applied as a solid composition, or as a bead of any suitable diameter, for example about one-eighth of an inch in diameter. However, in certain instances it may be preferable for the liquid friction control compositions to be applied using a brush or as a fine atomized spray. The bead method may have the potential disadvantage that under some circumstances it may lead to wheel slip, possibly because the bead has not dried completely. A finely atomized spray may provide for faster drying of the composition, more uniform distribution of the material on top of the rail and may provide for improved lateral force reduction and retentivity. An atomized spray application of the liquid friction control compositions of the present invention may be preferable for on-board transit system application, on-board locomotive application and hirail vehicle application, but the use of atomized spray is not limited to these systems. However, as someone of skill in the art will understand, some compositions of the present invention may not be ideally suited for application by atomized spray, such as liquid friction control compositions contemplated by the present invention which are highly viscous.

Atomized spray application is also suitable for applying combinations of liquid friction modifier compositions of the present invention to different areas of the rail for optimizing the interactions between the rail-wheel interface. For example, one set of applicator systems and nozzles applies a friction modifier, for example but not limited to, an HPF composition to the heads of both rails, to reduce lateral slip-stick of the wheel tread across the rail head, while another applicator and nozzle system may apply a low friction composition, for example but not limited to LCF, to the gauge face of the outside rail to reduce the flanging effect of the wheel of the lead axle of a rail car. It is also possible to apply one frictional modifier of the present invention as a atomized spray, for example to the gauge face of the rail, with a second frictional modifier applied as a bead or as a solid stick on the rail head.

Liquid friction control compositions according to the present invention which are contemplated to be applied as an atomized spray preferably exhibit characteristics, such as, but not limited to a reduction of course contaminants which may lead to clogging of the spray nozzles of the delivery device, and reduction of viscosity to ensure proper flow through the spray system of the delivery device and minimize agglomeration of particles. Materials such as, but not limited to, bentonite may comprise coarse particles which clog nozzles with small diameters. However, materials of a controlled, particle size, for example but not limited to particles of less than about 50 μM may be used for spray application.

Alternatively, but not to be considered limiting, the liquid friction control compositions of the present invention may be applied through wayside (trackside) application, wherein a wheel counter may trigger a pump to eject the composition of the present invention through narrow ports onto the top of a rail. In such an embodiment, the unit is preferably located before the entrance to a curve and the material is distributed by the wheels down into the curve where the composition of the current invention may reduce noise, lateral forces, the development of corrugations, or combination thereof.

Specific compositions of the liquid friction control compositions of the current invention may be better suited for wayside application. For example, it is preferable that compositions for wayside application dry by forming a light skin on the surface without thorough drying. Compositions which dry "through" may clog nozzle ports of the wayside applicator and be difficult to remove. Preferably, liquid friction control compositions for wayside application comprise a form of carboxymethylcellulose (CMC) in place of bentonite as the binder.

The liquid friction modifier compositions of the present invention may be prepared using a high-speed mixer to disperse the components. A suitable amount of water is placed in a mixing vat and the rheological control agent is added slowly until all the rheological control agent is wetted out. The friction modifier is then added in small quantities and each addition thereof is allowed to disperse fully before subsequent additions of friction modifier are made. If the mixture comprises a lubricant, this component is added slowly and each addition is allowed to disperse fully before making subsequent additions. Subsequently, the retentivity agent and other components, for example wetting agent, antibacterial agent, are added along with the remaining water and the composition is mixed thoroughly.

While the method of preparing the friction modifier compositions of the current invention have been disclosed above, those of skill in the art will note that several variations for preparing the formulations may exist without departing from the spirit and the scope of the current invention.

The liquid friction control compositions of the current invention preferably dehydrate following application onto a surface, and prior to functioning as a friction control composition. For example, but not wishing to be limiting, compositions of the present invention may be painted on a rail surface prior to the rail surface engaging a wheel of a train. The water, and any other liquid component in the compositions of the present invention may evaporate prior to engaging the wheel of a train. Upon dehydration, the liquid friction control compositions of the present invention preferably form a solid film which enhances adhesion of the other components of the composition, such as the friction modifier, and lubricant, if present. Further, after dehydration, the rheological control agent may also reduce reabsorption of water and prevent its removal from surfaces by rain or other effects. Thus, the liquid friction control compositions of the present invention are specifically contemplated to undergo dehydration prior to acting as friction control compositions. However, in certain applications contemplated by the present invention, the liquid friction control compositions of the present invention may be sprayed directly onto the rail by a pump located on the train or alternatively, the compositions may be pumped onto the rail following the sensing of an approaching train. Someone of skill in the art will appreciate that frictional forces and high temperatures associated with the steel-wheel travelling over the steel-rail may generate sufficient heat to rapidly dehydrate the composition.

The friction modifier compositions of the present invention may comprise components that one of skill in the art will appreciate may be substituted or varied without departing from the scope and spirit of the present invention. In addition, it is fully contemplated that the friction modifier compositions of the present invention may be used in combination with other lubricants or friction control compositions. For example, but not wishing to be limiting, the compositions of the current invention may be used with other friction control compositions such as, but not limited to those disclosed in U.S. Pat. Nos. 5,308,516 and 5,173,204. In such an embodiment, it is fully contemplated that the friction control composition of the present invention may be applied to the rail head while a composition which decreases the coefficient of friction may be applied to the gauge face or the wheel flange.

The above description is not intended to limit the claimed invention in any manner, furthermore, the discussed combination of features might not be absolutely necessary for the inventive solution.

All references are herein incorporated by reference.

The present invention will be further illustrated in the following examples. However, it is to be understood that these examples are for illustrative purposes only, and should not be used to limit the scope of the present invention in any manner.

EXAMPLE 1

Characterization of Liquid Friction Control Compositions

Amsler Protocol

A composition is applied to a clean disc in a controlled manner to produce a desired thickness of coating on the disc. For the analysis disclosed herein the compositions are applied using a fine paint brush to ensure complete coating of the disc surface. The amount of applied composition is determined by weighing the disc before and after application of the composition. Composition coatings range from 2 to 12 mg/disc. The composition is allowed to dry completely prior to testing. Typically, the coated discs are left to dry for at least an 8 hour period. The discs are loaded onto the amsler machine, brought into contact and a load is applied from about 680 to 745 N, in order to obtain a similar Hertzian Pressure (MPa) over different creep levels resulting from the use of different diameter disc combinations. Unless otherwise indicated, tests are performed at 3% creep level (disc diameters 53 mm and 49.5 mm; see Table 1)). For all disc size combinations (and creep levels from 3 to 30%) the speed of rotation is 10% higher for the lower disc than the upper disc. The coefficient of friction is determined by computer from the torque measured by the amsler machine. The test is carried out until the coefficient of friction reaches 0.4, and the number of cycles or seconds determined for each tested composition.

TABLE 1

Disc diameters for different creep levels

| Creep levels (%) | D1 (mm) | D2 (mm) |
|---|---|---|
| 3 | 53 | 49.5 |
| 10 | 50 | 50.1 |
| 15 | 40.3 | 42.4 |
| 24 | 42.2 | 48.4 |

Standard Manufacturing Process for LCF, HPF or VHPF:

1) To about half of the water, add the full amount of rheological agent and allow the mixture to disperse for about 5 minutes;
2) Add CO-630™ and allow to disperse for about 5 minutes;
3) Add friction modifier, if present, in small amounts to the mixture, allowing each addition to completely disperse prior to making subsequent additions;
4) Add lubricant, if present in small amounts, allowing each addition to completely disperse prior to making subsequent additions;
5) Allow mixture to disperse for 5 minutes.
6) Remove sample from the vat and if desired, perform viscosity, specific gravity and filtering tests and adjust ingredients to meet desired specifications;
7) Decrease the speed of the dispenser and add retentivity agent, consistency agent, preservative, wetting agent and defoaming agent;
8) Add remaining water and mix thoroughly.

Examples of sample LCF, HPF and VHPF compositions are presented in Tables 2, 3 and 4, below. Results obtained from amsler tests for each of these compositions are displayed in FIGS. 1A, 1B, and 1C.

TABLE 2

Sample LCF Composition

| Component | Percent (wt %) |
|---|---|
| Water | 48.1 |
| Propylene Glycol | 13.38 |
| Bentonite | 6.67 |
| Molybdenum sulfide | 13.38 |
| Ammonia | 0.31 |
| RHOPLEX ™ 284 | 8.48 |
| OXABAN A ™ | 0.07 |
| CO-630 ™ | 0.1 |
| Methanol | 4.75 |

The LCF composition of Table 2 is prepared as outlined above, and tested using an amsler machine. Results from the amsler test for the LCF composition are shown in FIG. 1A.

These results show that the LCF composition is characterized with having a low coefficient of friction with increased creep levels.

TABLE 3

Sample HPF Composition

| Component | Percent (wt %) |
|---|---|
| Water | 55.77 |
| Propylene Glycol | 14.7 |
| Bentonite | 7.35 |
| Molybdenum sulfide | 4.03 |
| Talk | 4.03 |
| Ammonia | 0.37 |
| RHOPLEX ™ 284 | 8.82 |
| OXABAN A ™ | 0.7 |
| CO-630 ™ | 0.11 |
| Methanol | 4.75 |

Amsler results for different creep levels for the HPF composition listed in Table 3 are shown in FIG. 1B. HPF compositions are characterized as having an increase in the coefficient of friction with increased creep levels.

Extending the Effect of an HPF Composition Applied to a Steel Surface in Sliding-rolling Contact with Another Steel Surface by Adding a Retentivity Agent The composition of Table 3 was modified to obtain levels of an acrylic retentivity agent (Rhoplex 284) of 0%, 3%, 7% and 10%. The increased amount of retentivity agent was added in place of water, on a wt % basis. These different compositions were then tested using the amsler machine (3% creep level) to determine the length of time the composition maintains a low and steady coefficient of friction. The analysis was stopped when the coefficient of friction reached 0.4. The results, presented in FIG. 3A, demonstrate that the addition of a retentivity agent increases the duration of the effect (reduced coefficient of friction) of the HPF composition. A coefficient of 0.4 is reached with an HPF composition lacking any retentivity agent after about 3000 cycles. The number of cycles increased to 4,000 with HPF compositions comprising 3% retentivity agent. With HPF comprising 7% acrylic retentivity agent, the coefficient of friction is below 0.4 for 6200 cycles, and with HPF comprising 10% acrylic retentivity agent, 8,200 cycles are reached.

The composition of Table 3 was modified to obtain levels of several different retentivity agents included into the composition at 16%. The retentivity agent was added in place of water, on a wt % basis. These different compositions were then tested using the amsler machine (creep level 3%) to determine the number of cycles that the composition maintains a coefficient of friction below 0.4. The results are presented in Table 3A.

TABLE 3A

Effect of various retentivity agents within an HPF composition on the retentivity of the composition on a steel surface in rolling sliding contact.

| Retentivity Agent | No. of cycles before CoF >0.4 |
|---|---|
| No retentivity agent | 3200 |
| ACRONAL ™ | 5600 |

TABLE 3A-continued

Effect of various retentivity agents within an HPF composition on the retentivity of the composition on a steel surface in rolling sliding contact.

| Retentivity Agent | No. of cycles before CoF >0.4 |
|---|---|
| AIRFLEX ™ 728 | 6400 |
| ANCARES ™ AR 550 | 7850 |
| RHOPLEX ™ AC 264 | 4900 |

These results demonstrate that a range of film-forming retentivity agents improve the retentivity of friction control compositions of the present invention.

Effect of an Epoxy Retentivity Agent

The composition of Table 3 was modified to obtain levels of an epoxy retentivity agent (ANCARES™ AR 550) of 0%, 8.9%, 15% and 30%. The increased amount of retentivity agent was added in place of water, on a wt % basis. These different compositions were then tested using the amsler machine (3% creep level) to determine the number of cycles the composition maintains a coefficient of friction below 0.4. The results demonstrate that the addition of an epoxy retentivity agent increases the duration of the effect (reduced coefficient of friction) of the HPF composition. An HPF composition lacking any retentivity agent, exhibits an increase in the coefficient of friction after about 3,200 cycles. The number of cycles is extended to about 7957 cycles with HPF compositions comprising 8.9%% epoxy retentivity agent. With HPF comprising 15% epoxy retentivity agent, the coefficient of friction is maintained at a low level for about 15983 cycles, and with HPF comprising 30% epoxy retentivity agent, the coefficient of friction is reduced for about 16750 cycles.

Different curing agents were also examined to determine if any modification to the retentivity of the composition between two steel surfaces in sliding-rolling contact. Adding from about 0.075 to about 0.18 (resin:curing agent on a wt % basis) of ANQUAMINE ™419 or ANQUAMINE ™456 maintained the retentivity of HPF at a high level as previously observed, about 3,000 to about 4,000 seconds (15480 cycles), over the range of curing agent tested. There was no effect in either increasing or decreasing the retentivity of the composition comprising an epoxy retentivity agent (ANCARES™ AR 550; at 28wt % within the HPF composition) with either of these two curing agents. However, increasing the amount of ANCAMINE™ K54 from 0.07 to about 0.67 (resin:curing agent on a wt % basis) increased the retentivity of the HPF composition from about 4,000 seconds (15500 cycles) at 0.07 (resin:curing agent wt %; equivalent to the other curing agents tested), to about 5,000 seconds (19350 cycles) at 0.28 (resin:curing agent wt %), to about 7,000 seconds (27,000 cycles) at 0.48 (resin:curing agent wt %), and about 9,300 seconds (35990 cycles) at 0.67 (resin:curing agent wt %).

In the absence of any curing agent, and with an epoxy amount of 28 wt %, the retentivity of the HPF composition as determined by amsler testing was improved over HPF compositions comprising epoxy and a curing agent (about 4,000 seconds, 15500 cycles), to about 6900 seconds (26700 cycles). A higher retentivity is also observed with increased amounts of epoxy resin within the friction control composition, for example 8,000 seconds (as determined by amsler testing) in compositions comprising 78% resin. However, the amount of resin that can be added to the composition must not be such that the effect of the friction modifier is overcome. Formulations that lack any curing agent may prove useful under conditions that limit the use of separate storage tanks for storage of the friction control composition and curing agent, or if simplified application of the friction control composition is required.

These results demonstrate that epoxy resins improve the retentivity of friction control compositions of the present invention.

TABLE 4

Sample VHPF Composition*

| Component | Percent (wt %) |
|---|---|
| Water | 57.52 |
| Propylene Glycol | 21.54 |
| Bentonite | 8.08 |
| Barytes | 5.93 |
| Ammonia | 0.54 |
| RHOPLEX ™ 264 | 6.01 |
| OXABAN A ™ | 0.1 |
| Co-630 ™ | 0.16 |

*Mapico black (black iron oxide) may be added to colour the composition.

Amsler results for the composition listed in Table 4 are shown in FIG. 1C. VHPF compositions are characterized as having an increase in the coefficient of friction with with increased creep levels

EXAMPLE 2

Liquid Friction Control Compositions—Sample Composition 1

This example describes the preparation of another liquid frictional control composition characterized in exhibiting a high positive coefficient of friction. The components of this composition are listed in Table 5.

TABLE 5

Hig0h Positive Coefficient of Friction (HPF) Composition

| Component | Percent (wt %) |
|---|---|
| Water | 43.62 |
| Propylene Glycol | 14.17 |
| Bentonite | 2.45 |
| Molybdenum sulfide | 12 |
| Magnesium silicate | 12 |
| Ammonia | 0.28 |
| RHOPLEX ™ 264 | 15.08 |
| OXABAN A ™ | 0.28 |
| Co-630 ™ | 0.12 |

Propylene glycol may be increased by about 20% to enhance low temperature performance. This composition is prepared as outlined in Example 1.

The composition of Table 6, was applied on the top of rail using an atomized spray system comprising a primary pump that fed the liquid composition from a reservoir through a set of metering pumps. The composition is metered to an air-liquid nozzle where the primary liquid stream is atomized with 100 psi air. In such a manner a controlled amount of a composition may be applied onto the top of the rail. Application rates of 0.05 L/mile, 0.1 L/mile 0.094 L/mile and 0.15 L/mile were used. The composition was applied on a test track, high tonnage loop 2.7 miles long consisting of a range of track sections encountered under typicall conditions. Test trains accumilate 1.0 million gross ton (MTG) a day traffic density, using heavy axel loads of 39 tons. Train speed is set to a maximum of 40 mph. During the trials draw bar pull, and lateral force were measured using standard methods.

Figure 3C:
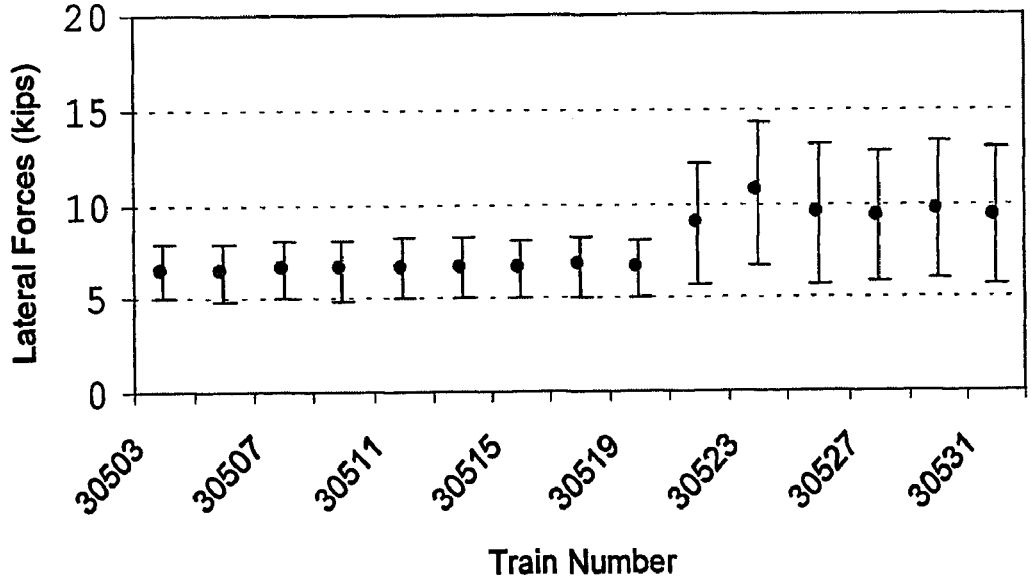
FIG. 3C shows the reduction of lateral force for repeated train passes over a 6° curve after applying the frictional control composition of example 1 (HPF) without providing any set time.
Figure 3D:
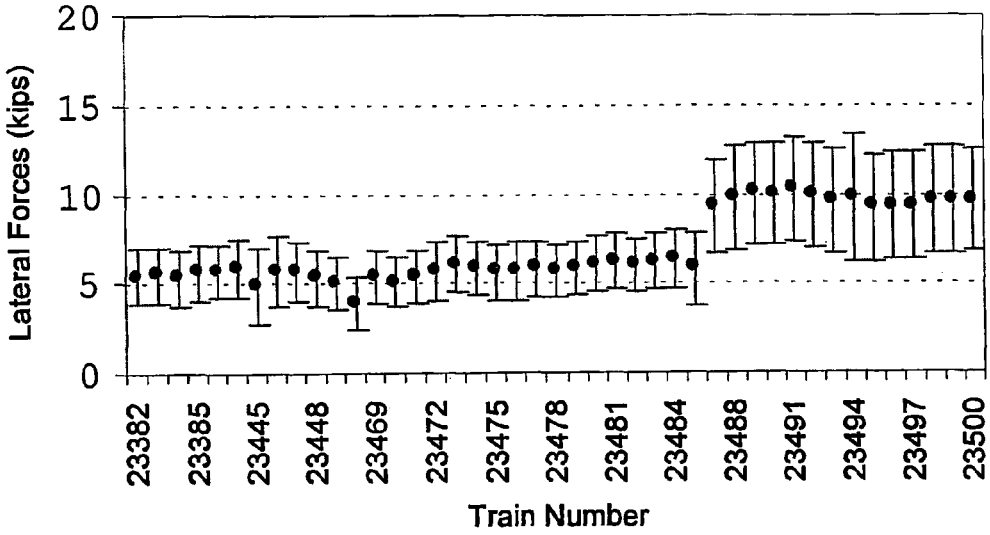
FIG. 3D shows the reduction in lateral force for repeated train passes over a 6° curve after applying the frictional control composition of Example 1 (HPF) at a rate of 0.150 L/mile. An increase in lateral force is observed after about 5,000 axle passes and allowing the friction modifier composition to set prior to any train travel. In the absence of a retentivity agent, an increase in lateral force is observed after about 100 to 200 axle passes (data not presented).
Figure 3E:
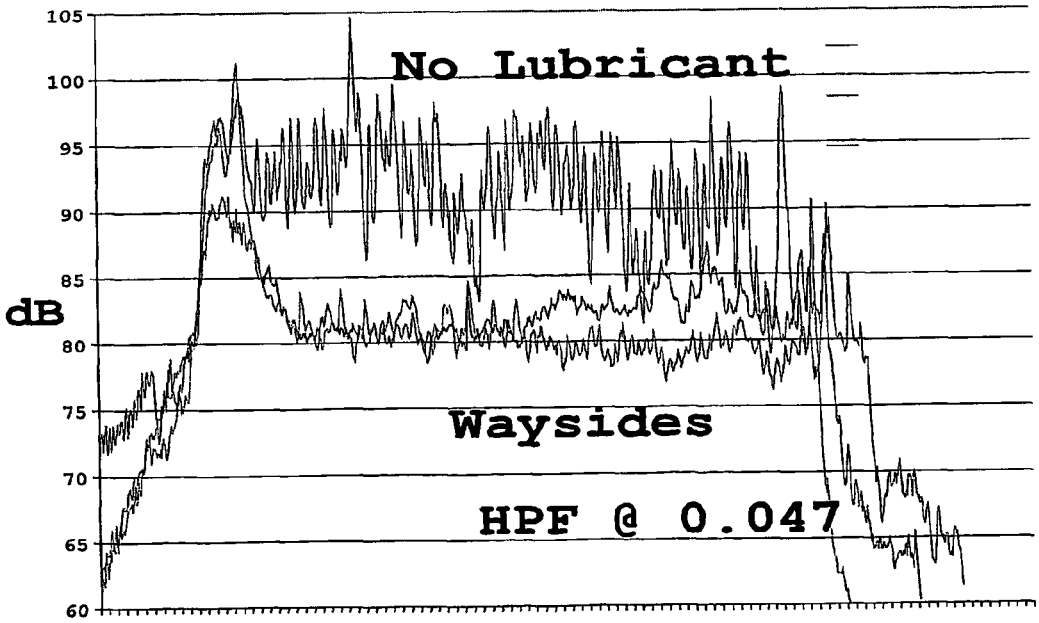
FIG. 3E shows a summary of results indicating reduced lateral force with increased application rate of the frictional control composition.

On uncoated track (no top of rail treatment, however, wayside lubrication, typically oil, was used) lateral forces varied from about 9 to about 13 kips (see FIG. 3B) Application of HPF (composition of Table 5) to the top of rail resulted in a decrease in lateral force from about 10 kips (control, no HPF applied) to about 7.8 kips at 0.05 L/mile, about 6 kips at 0.1 L/mile, about 5 kips at 0.094 L/mile, and about 4 kips at an application rate of 0.15 L/mile (high rail measurements; FIG. 3D). Similar results are observed with the HPF composition of Table 5 in the presence or absence of a retentivity agent.

In order to examine retentivity of the HPF composition, HPF (of Table 5, comprising a retentivity agent) was applied to the top of rail and let set for 16 hours prior to train travel. Reduced lateral force was observed for about 5000 axle passes (FIG. 3C). In the absence of any retentivity agent, an increase in lateral force is observed following 100-200 axle passes (data not presented). An intermediate level of retentivity is observed when the HPF composition of Table 5 is applied to the top of rail as the train is passing over the track and not permitted to set for any length of time, Under these conditions, when the application of HPF is turned off, an increase in lateral force is observed after about 1200 axle passes (FIG. 3D).

A reduction in noise is also observed using the liquid friction control composition of Table 5. A B&K noise meter was used to record decibel levels in the presence or absence of HPF application. In the absence of any top of rail treatment, the noise levels were about 85–95 decibels, while noise levels were reduced to about 80 decibels with an application of HPF at a rate of 0.047 L/mile.

A reduction in drawbar force (kw/hr) is also observed following the application of HPF to the top of rail. In the absence of HPF application, drawbar forces of about 307 kw/hr in the presence of wayside lubrication, to about 332 kw/hr in the absence of any treatment is observed. Following the application of HPF (Table 5 composition) drawbar forces of about 130 to about 228 were observed with an application rate of 0.15 L/mile.

Therefore, the HPF composition of Table 5 reduces lateral forces in rail curves, noise, reduces energy consumption, and the onset of corrugations in light rail systems. This liquid friction control composition may be applied to a rail as an atomized spray, but is not intended to be limited to application as an atomized spray, nor is the composition intended to be used only on rails. Furthermore, increased retentivity of the HPF composition is observed with the addition of a retentivity agent, supporting the data observed using the amsler machine.

EXAMPLE 3

Liquid Friction Control Composition—Sample HPF Composition 2

This example describes a liquid composition characterized in exhibiting a high and positive coefficient of friction. The components of this composition are listed in Table 6.

TABLE 6

| High and Positive Coefficient of Friction (HPF) Composition | |
|---|---|
| Component | Percent (wt %) |
| Water | 76.87 |
| Propylene Glycol | 14 |
| HECTABRITE ™ | 1.5 |
| Molybdenum disulfide | 1.99 |
| Magnesium silicate | 1.99 |
| Ammonia | 0.42 |
| RHOPLEX ™ 284 | 2.65 |
| OXABAN ™ A | 0.42 |
| CO-630 ™ | 0.1 |
| COLLOIDS 648 ™ | 0.06 |

The liquid friction control composition is prepared as outlined in Example 1, and may be applied to a rail as an atomized spray, but is not intended to be limited to application as an atomized spray, nor is the composition intended to be used only on rails.

This liquid friction control composition reduces lateral forces in rail curves, noise, the onset of corrugations, and reduces energy consumption, and is suitable for use within a rail system.

EXAMPLE 4

Liquid Friction Control Composition—Sample Composition 3

This example describes the preparation of several wayside liquid frictional control compositions characterized in exhibiting a high positive coefficient of friction. The components of these compositions are listed in Table 7.

TABLE 7

| High Positive Coefficient of Friction (HPF) Composition - wayside | | |
|---|---|---|
| Component | Percent (wt %) | |
| Water | 71.56 | 71.56 |
| Propylene glycol | 14.33 | 14.33 |
| METHOCEL ™ F4M | 1.79 | 1.79 |
| Molydenum disulfide | 3.93 | 3.93 |
| Magnesium silicate | 3.93 | — |
| Calcium carbonate | — | 3.93 |
| Ammonia | 0.35 | 0.35 |
| RHOPLEX ™ 284 | 3.93 | 3.39 |
| OXABAN ™ A | 0.07 | 0.07 |

Propylene glycol may be increased by about 20% to enhance low temperature performance. METHOCEL™ F4M may be increased by about 3% to increase product viscosity. METHOCEL™ may also be replaced with bentonite/glycerin combinations.

Propylene glycol may be increased by about 20% to enhance low temperature performance. Methocel™ F4M may be increased by about 3% to increase product viscosity. Methocel™ may also be replaced with bentionite/glycerin combinations.

The liquid friction control composition disclosed above may be used as a wayside friction control composition, but is not intended to be limited to such an application.

EXAMPLE 5

Liquid Friction Control Compositions—Sample Composition 4

This example describes the preparation of several other liquid frictional control composition characterized in exhibiting a high positive coefficient of friction. The components of these compositions are listed in Table 8.

TABLE 8

| High Positive Coefficient of Friction (HPF) Composition | | |
|---|---|---|
| | Percentage (wt %) | |
| Component | HPF Magnesium silicate | HPF clay |
| Water | 65.16 | 65.16 |
| Propylene glycol | 14 | 14 |
| Bentonite | 3 | 3 |
| Molybdenum disulfide | 4 | — |
| Graphite | — | 4 |
| Magnesium silicate | 4 | — |
| Kaolin clay | — | 4 |
| Ammonia | 0.42 | 0.42 |
| RHOPLEX ™ 284 | 8.9 | 8.9 |
| OXABAN ™ A | 0.42 | 0.42 |
| CO-630 ™ | 0.1 | 0.1 |

Propylene glycol may be increased by about 20% to enhance low temperature performance.

The liquid friction control composition, and variations thereof may be applied to a rail as an atomized spray, but is not intended to be limited to atomized spray application, nor is the composition intended to be used only on rails.

The liquid friction control composition of the present invention reduces lateral forces in rail curves, noise, the onset of corrugations, and reduces energy consumption.

EXAMPLE 6

Liquid Friction Control Compositions—Sample Composition 5

This example describes the preparation of a liquid frictional control composition characterized in exhibiting a very high and positive coefficient of friction. The components of this composition are listed in Table 9.

TABLE 9

| Very high and positive friction (VHPF) composition | |
|---|---|
| Component | Percentage (wt %) |
| Water | 72.85 |
| Propylene Glycol | 14.00 |
| HECTABRITE ™ | 1.50 |
| Barytes | 8.00 |
| Ammonia | 0.42 |
| RHOPLEX ™AC 264 | 2.65 |
| OXABAN A ™ | 0.42 |
| CO-630 ™ | 0.10 |
| COLLOIDS 648 ™ | 0.06 |

Propylene glycol may be increased by about 20% to enhance low temperature performance.

The liquid friction control composition, and variations thereof may be applied to a rail as an atomized spray, but is not intended to be limited to atomized spray application, nor is the composition intended to be used only on rails.

The liquid friction control composition of the present invention reduces lateral forces in rail curves, noise, the onset of corrugations, and reduces energy consumption.

EXAMPLE 7

Liquid Friction Control Compositions—Sample Composition 6

This example describes the preparation of a liquid frictional control composition characterized in exhibiting a low coefficient of friction. The components of this composition are listed in Table 10

TABLE 10

Low coefficient of friction (LCF) composition

| Component | Percentage (wt %) |
|---|---|
| Water | 72.85 |
| Propylene Glycol | 14.00 |
| HECTABRITE ™ | 1.50 |
| Molybdenum Disulphide | 8.00 |
| Ammonia | 0.42 |
| RHOPLEX ™ AC 264 | 2.65 |
| OXABAN A ™ | 0.42 |
| CO-630 ™ | 0.1 |
| COLLOIDS 648 ™ | 0.06 |

EXAMPLE 7

Liquid Friction Control Compositions—Sample Composition 7

This example describes the preparation of liquid frictional control compositions characterized in exhibiting a low coefficient of friction, and comprising or not comprising the retentivity agent RHOPLEX™ AC 264. The components of these compositions are listed in Table 11

TABLE 11

Low coefficient of friction (LCF) composition

| Component | Percentage (wt %) | |
|---|---|---|
| | with retentivity agent | no retentivity agent |
| Water | 56.19 | 58.73 |
| Propylene Glycol | 15.57 | 16.27 |
| Bentonite | 7.76 | 8.11 |
| Molybdenum Disulphide | 15.57 | 16.27 |
| Ammonia | 0.38 | 0.4 |
| RHOPLEX ™ AC 264 | 6.33 | 0 |
| Biocide (OXABAN A ™) | 0.08 | 0.08 |
| Co-630 ™ | 0.11 | 0.11 |

The retentivity of these compositions was determined using an amsler machine as outline in example 1. The number of cycles for each composition at a 30% creep level was determined at the point where the coefficient of friction reached 0.4. In the absence of retentivity agent, the number of cycles for LCF prior to reaching a coefficient of friction of 0.4 was from 300 to 1100 cycles. In the presence of the retentivity agent, the number of cycles increased from 20,000 to 52,000 cycles.

The embodiments of the invention in which an exclusive property or privilege is claimed are defined as follows:

1. A liquid friction control composition comprising:

(a) from about 40 to about 95 weight percent water;

(b) from about 0.5 to about 50 weight percent rheological control agent;

(c) from about 0.5 to about 40 weight percent retentivity agent;

(d) from 0 to about 40 weight percent lubricant; and (e) from 0 to about 25 weight percent friction modifier, wherein, if said lubricant is 0 weight percent, then said composition comprises at least about 0.5 weight percent friction modifier, wherein if said friction modifier is 0 weight percent, then said composition comprises at least about 1 weight percent lubricant, and wherein said retentivity agent is selected from the group consisting of an acrylic compound; a polyvinyl compound selected from the group consisting of polyvinyl alcohol, polyvinyl chloride, and a mixture thereof; an oxazoline compound; an epoxy compound; an alkyd compound; a modified alkyd compound; a urethane acrylic compound; an acrylic latex; an acrylic epoxy hybrid; a polyurethane dispersion; a styrene acrylate; a gum; a resin; and a mixture thereof.

2. The friction control composition of claim 1, further comprising a wetting agent, an antibacterial agent, a consistency modifier, a defoaming agent, or a combination thereof.

3. The friction control composition of claim 1, wherein said retentivity agent is selected from the group consisting of an acrylic compound, a polyvinyl alcohol, a polyvinyl chloride, an oxazoline compound, an epoxy compound, an alkyd compound, a urethane acrylic compound, a modified alkyd compound, an acrylic latex, an acrylic epoxy hybrid, a polyurethane, and a mixture thereof.

4. The friction control composition of claim 1, wherein said rheological control agent is selected from the group consisting of clay, bentonite, montmorillonite, caseine, carboxymethylcellulose, carboxyhydroxymethylcellulose, ethoxymethylcellulose, chitosan, starch, and a mixture thereof.

5. The friction control composition of claim 4, wherein said rheological control agent is carboxymethylcellulose.

6. The friction control composition of claim 1, wherein said retentivity agent is said acrylic compound.

7. The friction control composition of claim 1, wherein said retentivity agent is said polyvinyl compound.

8. The friction control composition of claim 1, wherein said retentivity agent is said oxazoline compound.

9. The friction control composition of claim 1, wherein said retentivity agent is said styrene acrylate.

10. The friction control composition of claim 1, wherein said retentivity agent is said epoxy compound selected from the group consisting of 2,2'-[(1-methylethylidene)bis(4,1-phenyleneoxymethylene)] bisoxirane homopolymer, bisphenol A-based epoxy, and a hydrocarbon resin.

11. The friction control composition of claim 1, wherein said retentivity agent is said epoxy compound and further comprises a curing agent selected from the group consisting of an amine or amide.

12. The friction control composition of claim 1 comprising:

(a) from about 40 to about 95 weight percent water;

(b) from about 0.5 to about 30 weight percent rheological control agent;

(c) from about 0.5 to about 25 weight percent friction modifier;

(d) from about 0.5 to about 40 weight percent retentivity agent; and (e) from about 0.02 to about 25 weight percent lubricant.

13. The friction control composition of claim 12, further comprising a consistency modifier, an antibacterial agent, a wetting agent, a defoaming agent or a combination thereof.

14. The friction control composition of claim 12, wherein said retentivity agent is selected from the group consisting of an acrylic compound, a polyvinyl alcohol, a polyvinyl chloride, an oxazoline compound, an epoxy compound, an alkyd compound, a modified alkyd compound, a urethane acrylic compound, an acrylic latex, an acrylic epoxy hybrid, a polyurethane, and a mixture thereof.

15. The friction control composition of claim 12, wherein said rheological control agent is selected from the group consisting of clay, bentonite, montmorillonite, caseine, carboxymethylcellulose, carboxyhydroxymethylcellulose, ethoxymethylcellulose, chitosan, starch, and a mixture thereof.

16. The friction control composition of claim 12, comprising:

(a) from about 50 to about 80 weight percent water;

(b) from about 1 to about 10 weight percent rheological control agent;

(c) from about 1 to about 5 weight percent friction modifier;

(d) from about 1 to about 16 weight percent retentivity agent; and (e) from about 1 to about 13 weight percent lubricant.

17. The friction control composition of claim 15, wherein said retentivity agent is an acrylic compound, and said rheological control agent is carboxymethylcellulose.

18. The friction control composition of claim 12, wherein said retentivity agent is an acrylic compound.

19. The friction control composition of claim 12, wherein said retentivity agent is a polyvinyl compound selected from the group consisting of polyvinyl alcohol, polyvinyl chloride, and a mixture thereof.

20. The friction control composition of claim 12, wherein said retentivity agent is an oxazoline compound.

21. The friction control composition of claim 14, wherein said retentivity agent is a styrene acrylate.

22. The friction control composition of claim 12, wherein said retentivity agent is an epoxy compound selected from the group consisting of 2,2'-[(1-methylethylidene)bis(4,1-phenyleneoxymethylene)]bisoxirane homopolymer, bisphenol A-based epoxy, and a hydrocarbon resin.

23. The friction control composition of claim 12, wherein said retentivity agent is an epoxy compound and further comprises a curing agent selected from the group consisting of an amine or amide.

24. The friction control composition of claim 1 comprising:

(a) from about 40 to about 80 weight percent water;

(b) from about 0.5 to about 30 weight percent rheological control agent;

(c) from about 2 to about 20 weight percent friction modifier; and (d) from about 0.5 to about 40 weight percent retentivity agent.

25. The friction control composition of claim 24, further comprising a consistency modifier, an antibacterial agent, a wetting agent, a defoaming agent or a combination thereof.

26. The friction control composition of claim 24, wherein said retentivity agent is selected from the group consisting of an acrylic compound, polyvinyl alcohol, polyvinyl chloride, an oxazoline compound, an epoxy compound, an alkyd compound, a modified alkyd compound, a urethane acrylic compound, an acrylic latex, an acrylic epoxy hybrid, a polyurethane, a styrene acrylate, and a mixture thereof.

27. The friction control composition of claim 24, wherein said rheological control agent is selected from the group consisting of clay, bentonite, montmorillonite, caseine, carboxymethylcellulose, carboxyhydroxymethylcellulose, ethoxymethylcellulose, chitosan, starch, and a mixture thereof.

28. The friction control composition of claim 24, comprising:

(a) from about 55 to 75 about weight percent water;

(b) from about 1 to about 9 weight percent rheological control agent;

(c) from about 5 to about 9 weight percent friction modifier; and (d) from about 2 to about 11 weight percent retentivity agent.

29. The friction control composition of claim 27, wherein said retentivity agent is an acrylic compound, and said rheological control agent is carboxymethylcellulose.

30. The friction control composition of claim 24, wherein said retentivity agent is an acrylic compound.

31. The friction control composition of claim 24, wherein said retentivity agent is a polyvinyl compound selected from the group consisting of polyvinyl alcohol, polyvinyl chloride and a mixture thereof.

32. The friction control composition of claim 24, wherein said retentivity agent is an oxazoline compound.

33. The friction control composition of claim 24, wherein said retentivity agent is a styrene acrylate.

34. The friction control composition of claim 24, wherein said retentivity agent is an epoxy compound selected from the group consisting of 2,2'-[(1-methylethylidene)bis(4,1-phenyleneoxymethylene)]bisoxirane homopolymer, bisphenol A-based epoxy, and a hydrocarbon resin.

35. The friction control composition of claim 24, wherein said retentivity agent is an epoxy compound and further comprises a curing agent selected from the group consisting of an amine or amide.

36. The friction control composition of claim 1 comprising:

(a) from about 40 to about 80 weight percent water;

(b) from about 0.5 to about 50 weight percent rheological control agent;

(c) from about 0.5 to about 40 weight percent retentivity agent; and (d) from about 1 to about 40 weight percent lubricant.

37. The friction control composition of claim 36, further comprising a consistency modifier, an antibacterial agent, a wetting agent, a defoaming agent or a combination thereof.

38. The friction control composition of claim 36, wherein said retentivity agent is selected from the group consisting of an acrylic compound, polyvinyl alcohol, polyvinyl chloride, an oxazoline compound, an epoxy compound, an alkyd compound, a modified alkyd compound, a urethane acrylic compound, an acrylic latex, an acrylic epoxy hybrid, a polyurethane, and a mixture thereof.

39. The friction control composition of claim 36, wherein said rheological control agent is selected from the group consisting of clay, bentonite, montmorillonite, caseine, carboxymethylcellulose, carboxyhydroxymethylcellulose, ethoxymethylcellulose, chitosan, starch, and a mixture thereof.

40. The friction control composition of claim 36 comprising:

(a) from about 45 to about 65 weight percent water;
(b) from about 4 to about 9 weight percent rheological control agent;
(c) from about 10 to about 20 weight percent retentivity agent; and
(d) from about 3 to about 13 weight percent lubricant.

41. The friction control composition of claim 39, wherein said retentivity agent is an acrylic compound, and said rheological control agent is carboxymethylcellulose.

42. The friction control composition of claim 36, wherein said retentivity agent is an acrylic compound.

43. The friction control composition of claim 36, wherein said retentivity agent is a polyvinyl compound selected from the group consisting of polyvinyl alcohol, polyvinyl chloride and a mixture thereof.

44. The friction control composition of claim 36, wherein said retentivity agent is an oxazoline compound.

45. The friction control composition of claim 36, wherein said retentivity agent is a styrene acrylate.

46. The friction control composition of claim 36, wherein said retentivity agent is an epoxy compound selected from the group consisting of 2,2'-[(1-methylethylidene)bis(4,1-phenyleneoxymethylene)]bisoxirane homopolymer, bisphenol A-based epoxy, and a hydrocarbon resin.

47. The friction control composition of claim 36, wherein said retentivity agent is an epoxy compound and further comprises a curing agent selected from the group consisting of an amine or amide.

48. A method of controlling noise between two steel surfaces in sliding-rolling contact, comprising applying said liquid friction control composition of claim 1 to at least one of said two steel surfaces.

49. The method of claim 48, wherein in said step of applying, said liquid friction control composition is sprayed onto said at least one of said two steel surfaces.

50. The method of claim 48, wherein in said step of applying, said liquid control friction composition is painted onto said at least one of said two steel surfaces.

51. A method of reducing lateral forces between two steel surfaces in sliding-rolling contact, comprising applying said liquid friction control composition of claim 1 to at least one of said two steel surfaces.

52. A method of reducing drawbar pull between two or more train cars, comprising applying said liquid friction control composition of claim 1 to a surface of one or more wheels of said two or more train cars, or the rail surface over which said two or more train cars travel.

53. A method of controlling noise between two steel surfaces in sliding-rolling contact, comprising applying a liquid friction control composition to at least one of said two steel surfaces, said composition comprising:
(a) from about 40 to about 95 weight percent water;
(b) from about 0.5 to about 50 weight percent rheological control agent;
(c) from about 0.5 to about 40 weight percent retentivity agent;
(d) from 0 to about 40 weight percent lubricant; and
(e) from 0 to about 25 weight percent friction modifier;
wherein, if said lubricant is 0 weight percent, then said composition comprises at least about 0.5 weight percent friction modifier, and wherein if said friction modifier is 0 weight percent, then said composition comprises at least about 1 weight percent lubricant.

54. The method of claim 53, wherein in said step of applying, said liquid friction control composition is sprayed onto said at least one of said two steel surfaces.

55. The method of claim 53, wherein in said step of applying, said liquid friction control composition is painted onto said at least one of said two steel surfaces.

56. A method of reducing lateral forces between two steel surfaces in sliding-rolling contact, comprising applying a liquid friction control composition to at least one of said two steel surfaces, said composition comprising:
(a) from about 40 to about 95 weight percent water;
(b) from about 0.5 to about 50 weight percent rheological control agent;
(c) from about 0.5 to about 40 weight percent retentivity agent;
(d) from 0 to about 40 weight percent lubricant; and
(e) from 0 to about 25 weight percent friction modifier;
wherein, if said lubricant is 0 weight percent, then said composition comprises at least about 0.5 weight percent friction modifier, and wherein if said friction modifier is 0 weight percent, then said composition comprises at least about 1 weight percent lubricant.

57. A method of reducing drawbar pull between two or more train cars, comprising applying a liquid friction control composition to a surface of one or more wheels of said two or more train cars, or the rail surface over which said two or more train cars travel, said composition comprising:
(a) from about 40 to about 95 weight percent water;
(b) from about 0.5 to about 50 weight percent rheological control agent;
(c) from about 0.5 to about 40 weight percent retentivity agent;
(d) from 0 to about 40 weight percent lubricant; and
(e) from 0 to about 25 weight percent friction modifier;
wherein, if said lubricant is 0 weight percent, then said composition comprises at least about 0.5 weight percent friction modifier, and wherein if said friction modifier is 0 weight percent, then said composition comprises at least about 1 weight percent lubricant.

58. A liquid friction control composition comprising:
(a) from about 40 to about 95 weight percent water;
(b) from about 0.5 to about 50 weight percent rheological control agent;
(c) from about 0.5 to about 40 weight percent retentivity agent;
(d) from 0 to about 40 weight percent lubricant; and
(e) from 0 to about 25 weight percent friction modifier,
wherein, if said lubricant is 0 weight percent, then said composition comprises at least about 0.5 weight percent friction modifier, wherein if said friction modifier is 0 weight percent, then said composition comprises at least about 1 weight percent lubricant, and
wherein said retentivity agent is selected from the group consisting of an oxazoline compound; an epoxy compound; and a mixture thereof.

59. The friction control composition of claim 58, further comprising a wetting agent, an antibacterial agent, a consistency modifier, a defoaming agent, or a combination thereof.

60. The friction control composition of claim 58, wherein said rheological control agent is selected from the group consisting of clay, bentonite, montmorillonite, caseine, carboxymethylcellulose, carboxyhydroxymethylcellulose, ethoxymethylcellulose, chitosan, starch, and a mixture thereof.

61. The friction control composition of claim 58, wherein said rheological control agent is carboxymethylcellulose.

62. The friction control composition of claim 58, wherein said retentivity agent is said oxazoline compound.

63. The friction control composition of claim 58, wherein said retentivity agent is said epoxy compound selected from the group consisting of 2,2'-[(1-methylethylidene)bis(4,1-phenyleneoxymethylene)]bisoxirane homopolymer, bisphenol A-based epoxy, and a hydrocarbon resin.

64. The friction control composition of claim 58, wherein said retentivity agent is said epoxy compound and further comprises a curing agent selected from the group consisting of an amine or amide.

65. The friction control composition of claim 58, comprising:

(a) from about 40 to about 95 weight percent water;
(b) from about 0.5 to about 30 weight percent rheological control agent;
(c) from about 0.5 to about 25 weight percent friction modifier;
(d) from about 0.5 to about 40 weight percent retentivity agent; and
(e) from about 0.02 to about 25 weight percent lubricant.

66. The friction control composition of claim 65, comprising:

(a) from about 50 to about 80 weight percent water;
(b) from about 1 to about 10 weight percent rheological control agent;
(c) from about 1 to about 5 weight percent friction modifier;
(d) from about 1 to about 16 weight percent retentivity agent; and
(e) from about 1 to about 13 weight percent lubricant.

67. The friction control composition of claim 58, comprising:

(a) from about 40 to about 80 weight percent water;
(b) from about 0.5 to about 30 weight percent rheological control agent;
(c) from about 2 to about 20 weight percent friction modifier; and
(d) from about 0.5 to about 40 weight percent retentivity agent.

68. The friction control composition of claim 67 comprising:

(a) from about 55 to about 75 weight percent water;
(b) from about 1 to about 9 weight percent rheological control agent;
(c) from about 5 to about 9 weight percent friction modifier; and
(d) from about 2 to about 11 weight percent retentivity agent.

69. The friction control composition of claim 58 comprising:

(a) from about 40 to about 80 weight percent water;
(b) from about 0.5 to about 50 weight percent rheological control agent;
(c) from about 0.5 to about 40 weight percent retentivity agent; and
(d) from about 1 to about 40 weight percent lubricant.

70. The friction control composition of claim 69 comprising:

(a) from about 45 to about 65 weight percent water;
(b) from about 4 to about 9 weight percent rheological control agent;
(c) from about 10 to about 20 weight percent retentivity agent; and
(d) from about 3 to about 13 weight percent lubricant.

71. A method of controlling noise between two steel surfaces in sliding-rolling contact, comprising applying said liquid friction control composition of claim 58 to at least one of said two steel surfaces.

72. The method of claim 71, wherein in said step of applying, said liquid friction control composition is sprayed onto said at least one of said two steel surfaces.

73. The method of claim 71, wherein in said step of applying, said liquid friction control composition is painted onto said at least one of said two steel surfaces.

74. A method of reducing lateral forces between two steel surfaces in sliding-rolling contact, comprising applying said liquid friction control composition of claim 58 to at least one of said two steel surfaces.

75. A method of reducing drawbar pull between two or more train cars, comprising applying said liquid friction control composition of claim 58 to a surface of one or more wheels of said two or more train cars, or the rail surface over which said two or more train cars travel.

76. A liquid friction control composition comprising:

(a) from about 40 to about 80 weight percent water;
(b) from about 0.5 to about 30 weight percent rheological control agent;
(c) from about 2 to about 20 weight percent friction modifier; and
(d) from about 0.5 to about 40 weight percent retentivity agent;

wherein the composition does not include a lubricant.

77. The liquid friction control composition of claim 76, further comprising a consistency modifier, an antibacterial agent, a wetting agent, a defoaming agent or a combination thereof.

78. The liquid friction control composition of claim 76, wherein said retentivity agent is selected from the group consisting of an acrylic compound, polyvinyl alcohol, polyvinyl chloride, an oxazoline compound, an epoxy compound, an alkyd compound, a modified alkyd compound, a urethane acrylic compound, an acrylic latex, an acrylic epoxy hybrid, a polyurethane, a styrene acrylate, styrene butadiene based compounds and a mixture thereof.

79. The friction control composition of claim 76, wherein said rheological control agent is selected from the group consisting of clay, bentonite, montmorillonite, caseine, carboxymethylcellulose, carboxyhydroxymethylcellulose, ethoxymethylcellulose, chitosan, starch, and a mixture thereof.

80. The friction control composition of claim 76, comprising:

(a) from about 55 to about 75 weight percent water;
(b) from about 1 to about 9 weight percent rheological control agent;
(c) from about 5 to about 9 weight percent friction modifier; and
(d) from about 2 to about 11 weight percent retentivity agent.

81. The friction control composition of claim 76, wherein said retentivity agent is an acrylic compound, and said rheological control agent is carboxymethylcellulose.

82. The friction control composition of claim 76, wherein said retentivity agent is an acrylic compound.

83. The friction control composition of claim 76, wherein said retentivity agent is a polyvinyl compound selected from the group consisting of polyvinyl alcohol, polyvinyl chloride and a mixture thereof.

84. The friction control composition of claim 76, wherein said retentivity agent is an oxazoline compound.

85. The friction control composition of claim 76, wherein said retentivity agent is a styrene butadiene compound.

86. The friction control composition of claim 76, wherein said retentivity agent is a styrene acrylate.

87. The friction control composition of claim 76, wherein said retentivity agent is an epoxy compound selected from the group consisting of 2,2'-[(1-methylethylidene)bis(4,1-phenyleneoxymethylene)]bisoxirane homopolymer, bisphenol A-based epoxy, and a hydrocarbon resin.

88. The friction control composition of claim 76, wherein said retentivity agent is an epoxy compound and further comprises a curing agent selected from the group consisting of an amine or amide.

89. A method of controlling noise between two steel surfaces in sliding-rolling contact, comprising applying said liquid friction control composition of claim 76 to at least one of said two steel surfaces.

90. The method of claim 89, wherein in said step of applying, said liquid friction control composition is sprayed onto said at least one of said two steel surfaces.

91. The method of claim 89, wherein in said step of applying, said liquid friction control composition is painted onto said at least one of said two steel surfaces.

* * * * *